US011279886B2

(12) United States Patent
Koseoglu

(10) Patent No.: US 11,279,886 B2
(45) **Date of Patent: *Mar. 22, 2022**

(54) HYDROCRACKING PROCESS AND SYSTEM INCLUDING SEPARATION OF HEAVY POLY NUCLEAR AROMATICS FROM RECYCLE BY SULFONATION

(71) Applicant: Saudi Arabian Oil Company, Dhahran (SA)

(72) Inventor: Omer Refa Koseoglu, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 141 days.

This patent is subject to a terminal disclaimer.

(21) Appl. No.: 16/674,355

(22) Filed: Nov. 5, 2019

(65) Prior Publication Data

US 2021/0130703 A1 May 6, 2021

(51) Int. Cl.

| | |
|---|---|
| ***C10G 29/00*** | (2006.01) |
| ***C10G 29/28*** | (2006.01) |
| ***C10G 67/02*** | (2006.01) |

(52) U.S. Cl.

CPC ..... *C10G 29/28* (2013.01); *C10G 67/02* (2013.01); *C10G 2300/1096* (2013.01); *C10G 2300/30* (2013.01); *C10G 2400/30* (2013.01)

(58) Field of Classification Search

CPC ..... C10G 29/28; C10G 47/00; C10G 47/36; C10G 67/00; C10G 67/02; C10G 2300/30; C10G 2300/1096; C10G 2400/30

See application file for complete search history.

(56) References Cited

U.S. PATENT DOCUMENTS 3,876,534 A 4/1975 Davidsohn
4,240,978 A 12/1980 Berg
(Continued)

FOREIGN PATENT DOCUMENTS

CA 2119413 A1 9/1994

OTHER PUBLICATIONS

Alan R. Katritzky et al., The sulfonation of aromatic and heteroaromatic polycyclic compounds, Tetrahedron 65 (2009) 1111-1114.
(Continued)

*Primary Examiner* — Prem C Singh
*Assistant Examiner* — Brandi M Doyle
(74) *Attorney, Agent, or Firm* — Leason Ellis LLP

(57) ABSTRACT

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation. A process for separation of HPNA and/or HPNA precursor compounds from a hydrocracked bottoms fraction of a hydroprocessing reaction effluent comprises contacting the hydrocracked bottoms fraction with an effective quantity of a sulfonation agent to produce corresponding sulfonated HPNA compounds and/or sulfonated HPNA precursor compounds, and to form a sulfonated hydrocracked bottoms fraction. The sulfonated hydrocracked bottoms fraction is separated into an HPNA-reduced hydrocracked bottoms portion and a sulfonated HPNA portion. All or a portion of the HPNA-reduced hydrocracked bottoms portion is recycled within the hydrocracking operation.

25 Claims, 8 Drawing Sheets

(56) References Cited

U.S. PATENT DOCUMENTS

| | | | | |
|---|---|---|---|---|
| 4,541,965 | A | 9/1985 | Thomson et al. | |
| 5,584,920 | A | 12/1996 | Sawatzky et al. | |
| 8,828,219 | B2 | 9/2014 | Koseoglu | |
| 2005/0258070 | A1 | 11/2005 | Varadaraj et al. | |
| 2006/0213809 | A1* | 9/2006 | Barthelet | C10G 25/003 208/120.1 |
| 2008/0251418 | A1* | 10/2008 | Francisco | C10G 50/00 208/44 |
| 2009/0184029 | A1 | 7/2009 | Varadaraj et al. | |
| 2009/0314689 | A1 | 12/2009 | Varadaraj et al. | |
| 2018/0187100 | A1 | 7/2018 | Koseoglu et al. | |

OTHER PUBLICATIONS

PCT International Search Report and Written Opinion from corresponding PCT Application No. PCT/US2020/057922 dated Feb. 17, 2021.

Masoumeh Mousavi and Elham H. Fini, Non-Covalent π-Stacking Interactions between Asphaltene and Porphyrin in Bitumen, J. Chem. Inf. Model, 2020, 60, 4856-4866.

Teh Fu. Yen, J. G. Erdman and S. S. Pollack, Investigation of the Structure of Petroleum Asphaltenes by X-Ray Diffraction, Analytical Chemistry, 1961, 33, 11, 1587-1594.

* cited by examiner

HYDROCRACKING PROCESS AND SYSTEM INCLUDING SEPARATION OF HEAVY POLY NUCLEAR AROMATICS FROM RECYCLE BY SULFONATION

RELATED APPLICATIONS

Not applicable.

BACKGROUND OF THE INVENTION

Field of the Invention

The present invention relates to hydrocracking processes, and in particular to hydrocracking processes including separation of heavy poly nuclear aromatics from recycle streams using sulfonation.

Description of Related Art

Hydrocracking processes are used commercially in a large number of petroleum refineries. They are used to process a variety of feeds boiling within the range of about 370-520° C. in conventional hydrocracking units and boiling at 520° C. and above in residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen-to-carbon ratio and by removing organosulfur and organonitrogen compounds. The significant economic benefit derived from hydrocracking processes has resulted in substantial development of process improvements and more active catalysts.

In addition to sulfur-containing and nitrogen-containing compounds, a typical hydrocracking feedstream, such as vacuum gas oil (VGO), contains a small amount of poly nuclear aromatic (PNA) compounds, i.e., those containing less than seven fused aromatic rings. As the feedstream is subjected to hydroprocessing at elevated temperature and pressure, heavy poly nuclear aromatic (HPNA) compounds, i.e., those containing seven or more fused benzene rings, tend to form and are present in high concentration in the unconverted hydrocracker bottoms.

Heavy feedstreams such as demetallized oil (DMO) or deasphalted oil (DAO) have much higher concentrations of nitrogen, sulfur and PNA compounds than VGO feedstreams. These impurities can lower the overall efficiency of hydrocracking units by requiring higher operating temperature, higher hydrogen partial pressure or additional reactor/catalyst volume. In addition, high concentrations of impurities can accelerate catalyst deactivation.

Three major hydrocracking process schemes include single-stage once through hydrocracking, series-flow hydrocracking with or without recycle, and two-stage recycle hydrocracking. Single-stage once through hydrocracking is the simplest of the hydrocracker configurations and typically occurs at operating conditions that are more severe than hydrotreating processes, and less severe than conventional full-pressure hydrocracking processes. It uses one or more reactors for both the treating steps and the cracking reaction, so the catalyst must be capable of both hydrotreating and hydrocracking. This configuration is cost effective, but typically results in relatively low product yields (for example, a maximum conversion rate of about 60%). Single-stage hydrocracking is often designed to maximize mid-distillate yield over single or dual catalyst systems. Dual catalyst systems can be used in a stacked-bed configuration or in two different reactors. The effluents are passed to a fractionator column to separate the $H_2S$, $NH_3$, light gases ($C_1$-$C_4$), naphtha and diesel products boiling in the temperature range of 36–370° C. The hydrocarbons boiling above 370° C. are typically unconverted bottoms that, in single stage systems, are passed to other refinery operations.

Series-flow hydrocracking with or without recycle is one of the most commonly used configurations. It uses one reactor (containing both treating and cracking catalysts) or two or more reactors for both treating and cracking reaction steps. In a series-flow configuration the entire hydrocracked product stream from the first reaction zone, including light gases (typically $C_1$-$C_4$, $H_2S$, $NH_3$) and all remaining hydrocarbons, are sent to the second reaction zone. Unconverted bottoms from the fractionator column are recycled back into the first reactor for further cracking. This configuration converts heavy crude oil fractions, i.e., vacuum gas oil, into light products and has the potential to maximize the yield of naphtha, jet fuel, or diesel, depending on the recycle cut point used in the distillation section.

Two-stage recycle hydrocracking uses two reactors and unconverted bottoms from the fractionation column are passed to the second reactor for further cracking. Since the first reactor accomplishes both hydrotreating and hydrocracking, the feed to second reactor is virtually free of ammonia and hydrogen sulfide. This permits the use of high-performance zeolite catalysts which are susceptible to poisoning by sulfur or nitrogen compounds.

A typical hydrocracking feedstock is vacuum gas oils boiling in the nominal range of 370-565° C. Heavier oil feedstreams such as DMO or DAO, alone or blended with vacuum gas oil, is processed in a hydrocracking unit. For instance, a typical hydrocracking unit processes vacuum gas oils that contain from 10V % to 25V % of DMO or DAO for optimum operation. A 100% DMO or DAO feed can also be processed, typically under more severe conditions, since the DMO or DAO stream contains significantly more nitrogen compounds (2,000 ppmw vs. 1,000 ppmw) and a higher micro carbon residue (MCR) content than the VGO stream (10 W % vs.<1 W %).

DMO or DAO content in blended feedstocks to a hydrocracking unit can lower the overall efficiency of the unit by increasing operating temperature or reactor/catalyst volume for existing units, or by increasing hydrogen partial pressure requirements or reactor/catalyst volume for grass-roots units. These impurities can also reduce the quality of the desired intermediate hydrocarbon products in the hydrocracking effluent. When DMO or DAO are processed in a hydrocracker, further processing of hydrocracking reactor effluents may be required to meet the refinery fuel specifications, depending upon the refinery configuration. When the hydrocracking unit is operating in its desired mode, that is to say, discharging a high quality effluent product stream, its effluent can be utilized in blending and to produce gasoline, kerosene and diesel fuel to meet established fuel specifications.

In addition, formation of HPNA compounds is an undesirable side reaction that occurs in recycle hydrocrackers. The HPNA molecules form by dehydrogenation of larger hydro-aromatic molecules or cyclization of side chains onto existing HPNA molecules followed by dehydrogenation, which is favored as the reaction temperature increases. HPNA formation depends on many known factors including the type of feedstock, catalyst selection, process configuration, and operating conditions. Since HPNA molecules accumulate in the recycle system and then cause equipment fouling, HPNA formation must be controlled in the hydrocracking process.

The rate of formation of the various HPNA compounds increases with higher conversion and heavier feed stocks. The fouling of equipment may not be apparent until large amounts of HPNA accumulate in the recycle liquid loop. The problem of HPNA formation is of universal concern to refiners and various removal methods have been developed by refinery operators to reduce its impact.

Conventional methods to separate or treat heavy polynuclear aromatics formed in the hydrocracking process include adsorption, hydrogenation, extraction, solvent deasphalting and purging, or "bleeding" a portion of the recycle stream from the system to reduce the build-up of HPNA compounds and cracking or utilizing the bleed stream elsewhere in the refinery. The hydrocracker bottoms are treated in separate units to eliminate the HPNA molecules and recycle HPNA-free bottoms back to the hydrocracking reactor.

As noted above, one alternative when operating the hydrocracking unit in the recycle mode is to purge a certain amount of the recycle liquid to reduce the concentration of HPNA that is introduced with the fresh feed, although purging reduces the conversion rate to below 100%. Another solution to the build-up problem is to eliminate the HPNAs by passing them to a special purpose vacuum column which effectively fractionates 98-99% of the recycle stream leaving most of the HPNAs at the bottom of the column for rejection from the system as fractionator bottoms. This alternative incurs the additional capital cost and operating expenses of a dedicated fractionation column.

The problem therefore exists of providing a process for removing HPNA compounds from the bottoms recycle stream of a hydrocracking unit that is more efficient and cost effective than the known processes.

SUMMARY OF THE INVENTION

Hydrocracked bottoms fractions are treated to separate HPNA compounds and/or HPNA precursor compounds and produce a reduced-HPNA hydrocracked bottoms fraction effective for recycle, in a configuration of a single-stage hydrocracking reactor, series-flow once through hydrocracking operation, or two-stage hydrocracking operation.

A process for separation of HPNA and/or HPNA precursor compounds from a hydrocracked bottoms fraction of a hydroprocessing reaction effluent comprises contacting the hydrocracked bottoms fraction with an effective quantity of a sulfonation agent. The contacting occurs under effective conditions to promote reaction with HPNA and/or HPNA precursor compounds to produce corresponding aromatic sulfonates and form a sulfonated hydrocracked bottoms fraction. The sulfonated hydrocracked bottoms fraction is separated into an HPNA-reduced hydrocracked bottoms portion and a sulfonated HPNA portion. In certain embodiments, the sulfonation agent used is liquid. In further embodiments, the sulfonation agent is gaseous.

The above methods for separation of HPNA and/or HPNA precursor compounds by sulfonation can be integrated in a hydrocracking operation using a single reactor or plural reactors in a "once-through" configuration. Accordingly, in certain embodiments a hydrocracking process for treating a heavy hydrocarbon feedstream which contains undesired nitrogen-containing compounds and poly-nuclear aromatic compounds is provided that comprises subjecting the hydrocarbon feedstream to one or more hydrocracking stages to produce a hydrocracked effluent. The hydrocracked effluent is fractioned to recover hydrocracked products and a hydrocracked bottoms fraction containing HPNA and/or HPNA precursor compounds. The hydrocracked bottoms fraction is contacted with an effective quantity of sulfonation agent promote reaction with HPNA and/or HPNA precursor compounds to produce corresponding aromatic sulfonates and form a sulfonated hydrocracked bottoms fraction. The sulfonated hydrocracked bottoms fraction is separated into an HPNA-reduced hydrocracked bottoms portion and a sulfonated HPNA portion. All or a portion of the HPNA-reduced hydrocracked bottoms portion is recycled.

In additional embodiments, the above methods for separation of HPNA and/or HPNA precursor compounds by sulfonation can be integrated in a two-stage hydrocracking configuration. Accordingly, in certain embodiments, a hydrocracking process for treating a heavy hydrocarbon feedstream which contains undesired nitrogen-containing compounds and poly-nuclear aromatic compounds is provided that comprises subjecting the hydrocarbon feedstream to one or more first hydrocracking stages to produce a first stage effluent. The first stage effluent is fractioned to recover hydrocracked products and a hydrocracked bottoms fraction containing HPNA and/or HPNA precursor compounds. The hydrocracked bottoms fraction is contacted with an effective quantity of sulfonation agent promote reaction with HPNA and/or HPNA precursor compounds to produce corresponding aromatic sulfonates and form a sulfonated hydrocracked bottoms fraction. The sulfonated hydrocracked bottoms fraction is separated into an HPNA-reduced hydrocracked bottoms portion and a sulfonated HPNA portion. All or a portion of the HPNA-reduced hydrocracked bottoms portion is recycled.

In certain embodiments, the sulfonated HPNA-containing hydrocracked bottoms fraction is separated using an aqueous separation process. In additional embodiments a solvent extraction process based on aromatic selectively can be used. In further embodiments, the sulfonated hydrocracked bottoms fraction can be separated using two or more of the separation methods described herein, for instance, an aqueous separation process followed by a solvent extraction HPNA separation process based on aromatic selectively.

In certain embodiments, a process for separation of HPNA compounds and/or HPNA precursor compounds from a hydrocracked bottoms fraction prior to recycling within a hydrocracking operation comprises: contacting the hydrocracked bottoms fraction with an effective quantity of a sulfonation agent to promote reaction with HPNA and/or HPNA precursor compounds, to produce corresponding sulfonated HPNA compounds and/or sulfonated HPNA precursor compounds, and to form a sulfonated hydrocracked bottoms fraction; separating the sulfonated hydrocracked bottoms fraction into an HPNA-reduced hydrocracked bottoms portion and a sulfonated HPNA portion; recycling all or a portion of the HPNA-reduced hydrocracked bottoms portion within the hydrocracking operation; and discharging the precipitated HPNA portion. In certain embodiments, two stage hydrocracking process comprises subjecting a hydrocarbon stream to a first hydrocracking stage to produce a first hydrocracked effluent; fractionating the first hydrocracked effluent to recover one or more hydrocracked product fractions and a bottoms fraction corresponding to the hydrocracked bottoms fraction of in the above process for separation of HPNA; wherein recycling all or a portion of the HPNA-reduced hydrocracked bottoms portion within the hydrocracking operation comprises passing all or a portion of the HPNA-reduced hydrocracked bottoms portion to a second hydrocracking stage to produce a second hydrocracked effluent; and optionally wherein the second hydrocracked effluent is fractionated with the first hydrocracked effluent. In certain embodiments, a hydrocracking process comprising subjecting a hydrocarbon stream to one or more hydrocracking stages to produce a hydrocracked effluent; fractionating the hydrocracked effluent to recover one or more hydrocracked product fractions and a hydrocracked bottoms fraction corresponding to the hydrocracked bottoms fraction of in the above process for separation of HPNA; and wherein recycling all or a portion of the HPNA-reduced hydrocracked bottoms portion within the hydrocracking operation comprises recycling all or a portion of the HPNA-reduced hydrocracked bottoms portion to at least one of the one or more hydrocracking stages. In certain embodiments, the sulfonation agent is liquid phase. A liquid phase sulfonation agent can be sulfuric acid under effective operating conditions. In additional embodiments, the sulfonation agent is gas phase. A gas phase sulfonation agent can be selected from the group consisting of $SO_2$, $SO_3$ and mixtures thereof, under effective operating conditions. In certain embodiments the process further comprises contacting an additional feed with the sulfonation agent.

In certain embodiments, a system for separation of HPNA compounds and/or HPNA precursor compounds from a hydrocracked bottoms fraction is provided comprising a sulfonation reaction zone having one or more inlets in fluid communication with a source of sulfonation agent, and one or more inlets in fluid communication with a hydrocracked bottoms outlet of a hydrocracking fractionating zone, the sulfonation reaction zone having one or more outlets for discharging a sulfonated hydrocracked bottoms fraction; and a separation zone having one or more inlets in fluid communication with the outlet(s) discharging the sulfonated hydrocracked bottoms fraction, one or more outlets for discharging an HPNA-reduced hydrocracked bottoms portion in fluid communication with a hydrocracking operation as a bottoms recycle stream, and one or more outlets for discharging a sulfonated HPNA portion. In certain embodiments, a two stage hydrocracking system comprises a first hydrocracking reaction zone having one or more inlets in fluid communication with a source of an initial feedstock, and one or more outlets for discharging a first hydrocracked effluent stream; a fractionating zone having one or more inlets in fluid communication with the outlet(s) for discharging the first hydrocracked effluent stream, one or more outlets discharging a hydrocracked product fractions, and one or more outlets discharging a hydrocracked bottoms fraction in fluid communication with the HPNA separation zone as above; a second hydrocracking reaction zone having one or more inlets in fluid communication with the outlet(s) for discharging the HPNA-reduced hydrocracked bottoms portion of the HPNA separation zone as above, and one or more outlets discharging a second hydrocracked effluent stream; and optionally wherein the outlet(s) for discharging the second hydrocracked effluent is in fluid communication with the fractioning zone. In certain embodiments, a hydrocracking system comprises a hydrocracking reaction zone having one or more inlets in fluid communication with a source of an initial feedstock and is in fluid communication with the HPNA-reduced hydrocracked bottoms portion from the outlet(s) of the HPNA separation zone as above, and one or more outlets discharging an effluent stream; and a fractionating zone having one or more inlets in fluid communication with the outlet(s) for discharging the effluent stream, one or more outlets discharging a hydrocracked product fractions, and one or more outlets discharging a hydrocracked bottoms fraction in fluid communication with the inlet(s) of the HPNA separation zone as above. In certain embodiments, the HPNA separation zone includes a contacting and/or mixing zone upstream of the sulfonation reaction zone. In certain embodiments, the HPNA separation zone is also in fluid communication with a source of additional feed.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
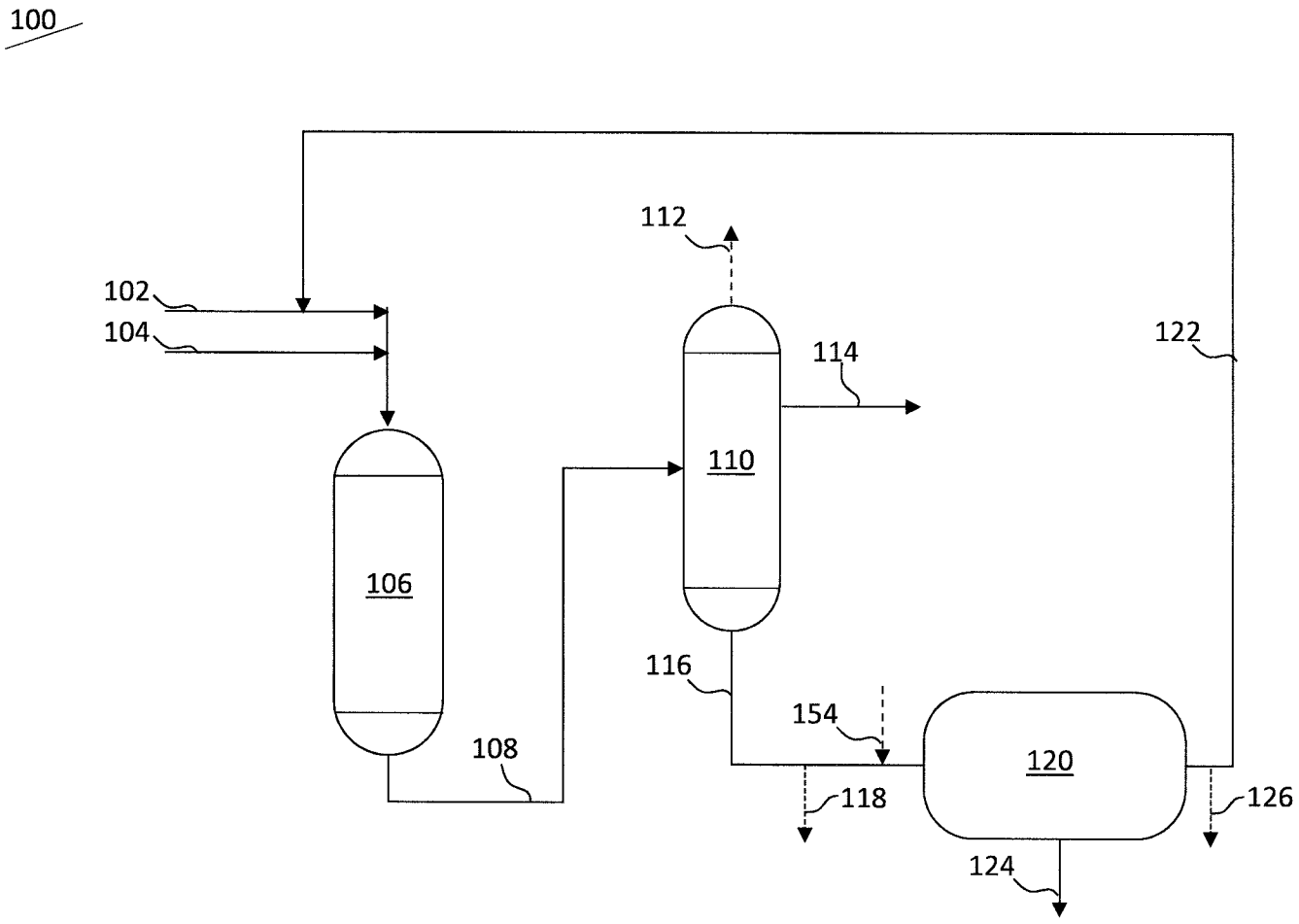
FIG. 1 is a process flow diagram of an embodiment of an integrated hydrocracking unit operation.

Integrated processes and systems are provided for to improve efficiency of hydrocracking operations, by removing HPNA and/or HPNA precursor compounds prior to recycling within a hydrocracking operation. The processes and systems herein are effective for different types of hydrocracking operations, and are also effective for a wide range of initial feedstocks obtained from various sources, such as one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations. The feedstream generally has a boiling point range within about 350-800, 350-700, 350-600 or 350-565° C.

As used herein, "HPNA compounds" and the shorthand expression "HPNA(s)" refers to fused polycyclic aromatic compounds having double bond equivalence (DBE) values of 19 and above, or having 7 or more rings, for example, including but not limited to coronenes ($C_{24}H_{12}$), benzocoronenes ($C_{28}H_{14}$), dibenzocorones ($C_{32}H_{16}$) and ovalenes ($C_{32}H_{14}$). The aromatic structure may have alkyl groups or naphthenic rings attached to it. For instance, coronene has 24 carbon atoms and 12 hydrogen atoms. Its double bond equivalency (DBE) is 19. DBE is calculated based on the sum of the number double bonds and number of rings. For example, the DBE value for coronene is 19 (7 rings+12 double-bonds). Examples of HPNA compounds are shown in Table 1.

As used herein, "HPNA precursors" are poly nuclear compounds having less than 7 aromatic rings.

As used herein, the term hydrocracking recycle stream is synonymous with the terms hydrocracker bottoms, hydrocracked bottoms, hydrocracker unconverted material and fractionator bottoms.

As used herein, the shorthand expressions "HPNAs/HPNA precursors," "HPNA compounds and HPNA precursor compounds," "HPNAs and HPNA precursors," and "HPNA compounds and/or HPNA precursor compounds" are used interchangeably and refer to a combination of HPNA compounds and HPNA precursor compounds unless more narrowly defined in context.

TABLE 1

| HPNAs | Ring # | Structure |
|---|---|---|
| benzoperylene | 6 | 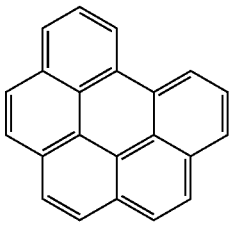 |
| coronene | 7 | 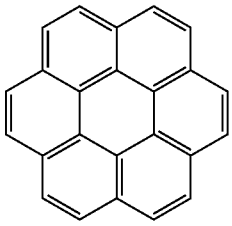 |

TABLE 1-continued

| HPNAs | Ring # | Structure |
|---|---|---|
| methylcoronene | 7 | 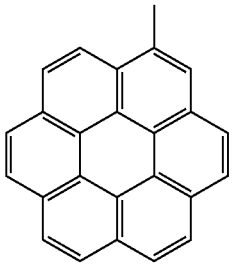 |
| naphthenocoronene | 9 | 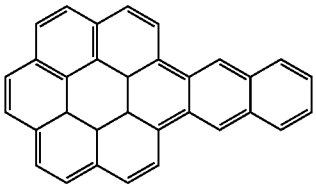 |
| dibenzocoronene | 9 | 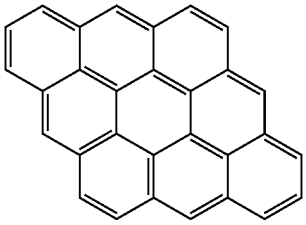 |
| ovalene | 10 | 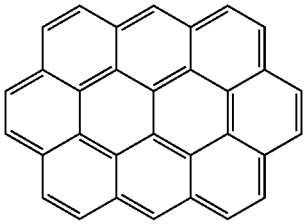 |

Volume percent or "V %" refers to a relative at conditions of 1 atmosphere pressure and 15° C.

The phrase "a major portion" with respect to a particular stream or plural streams, or content within a particular stream, means at least about 50 wt % and up to 100 wt %, or the same values of another specified unit.

The phrase "a significant portion" with respect to a particular stream or plural streams, or content within a particular stream, means at least about 75 wt % and up to 100 wt %, or the same values of another specified unit.

The phrase "a substantial portion" with respect to a particular stream or plural streams, or content within a particular stream, means at least about 90, 95, 98 or 99 wt % and up to 100 wt %, or the same values of another specified unit.

The phrase "a minor portion" with respect to a particular stream or plural streams, or content within a particular stream, means from about 1, 2, 4 or 10 wt %, up to about 20, 30, 40 or 50 wt %, or the same values of another specified unit.

The term "naphtha" as used herein refers to hydrocarbons boiling in the range of about 20-220, 20-210, 20-200, 20-190, 20-180, 20-170, 32-220, 32-210, 32-200, 32-190, 32-180, 32-170, 36-220, 36-210, 36-200, 36-190, 36-180 or 36-170° C.

The term "light naphtha" as used herein refers to hydrocarbons boiling in the range of about 20-110, 20-100, 20-90, 20-88, 32-110, 32-100, 32-90, 32-88, 36-110, 36-100, 36-90 or 36-88° C.

The term "middle distillates" as used herein relative to effluents from the atmospheric distillation unit or flash zone refers to hydrocarbons boiling in the range of about 170-370, 170-360, 170-350, 170-340, 170-320, 180-370, 180-360, 180-350, 180-340, 180-320, 190-370, 190-360, 190-350, 190-340, 190-320, 200-370, 200-360, 200-350, 200-340, 200-320, 210-370, 210-210, 210-350, 210-340, 210-320, 220-370, 220-220, 220-350, 220-340 or 220-320° C.

The term "unconverted oil" and its acronym "UCO," is used herein having its known meaning, and refers to a highly paraffinic fraction obtained from a separation zone associated with a hydroprocessing reactor, and contains reduced nitrogen, sulfur and nickel content relative to the reactor feed, and includes in certain embodiments hydrocarbons having an initial boiling point in the range of about 340-370° C., for instance about 340, 360 or 370° C., and an end point in the range of about 510-560° C., for instance about 540, 550, 560° C. or higher depending on the characteristics of the feed to the hydroprocessing reactor, and hydroprocessing reactor design and conditions. UCO is also known in the industry by other synonyms including "hydrowax."

The term "cracked diesel" refers to a hydrocarbon fraction obtained from a separation zone associated with a hydroprocessing reactor, and contains reduced nitrogen, sulfur and nickel content relative to the reactor feed, and includes in certain embodiments hydrocarbons having an initial boiling point corresponding to the end point of the cracked naphtha fraction(s) obtained from the separation zone associated with the hydroprocessing reactor, and having an end boiling point corresponding to the initial boiling point of the unconverted oil.

FIG. 1 is a process flow diagram of an embodiment of an integrated hydrocracking unit operation, system 100 including a hydrocracking reaction zone 106, a fractionating zone 110, and an HPNA separation zone 120. Reaction zone 106 generally includes one or more inlets in fluid communication with a source of initial feedstock 102, a source of hydrogen gas 104, and the HPNA separation zone 120 to receive a recycle stream comprising all or a portion of the HPNA-reduced bottoms fraction 122. Reaction zone 106 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of reaction zone 106 that discharge effluent stream 108 are in fluid communication with one or more inlets of the fractionating zone 110. In certain embodiments (not shown), effluents from the hydrocracking reaction vessels are cooled in an exchanger and sent to a high pressure hot and/or cold separator. The fractionating zone 110 includes one or more outlets for discharging a distillate fraction 114 containing cracked naphtha and cracked middle distillate/diesel products; and one or more outlets for discharging a bottoms fraction 116 containing unconverted oil. In certain embodiments, the fractionation zone 110 includes one or more outlets for discharging gases, stream 112, typically $H_2$, $H_2S$, $NH_3$, and light hydrocarbons ($C_1$-$C_4$).

The bottoms fraction 116 outlet is in fluid communication with one or more inlets of the HPNA separation zone 120. In certain embodiments one or more optional additional feeds, stream 154, are in fluid communication with one or more inlets of the HPNA separation zone 120. The HPNA separation zone 120 generally includes one or more outlets for discharging HPNA-reduced fractionator bottoms portion 122 and one or more outlets for discharging a sulfonated aromatics stream 124 containing sulfonated HPNA compounds and/or sulfonated HPNA precursor compounds. The outlet discharging HPNA-reduced fractionator bottoms 122 is in fluid communication with one or more inlets of reaction zone 106 for recycle of all or a portion of the stream. In certain embodiments, a bleed stream 118 is drawn from bottoms 116 upstream of the HPNA separation zone 120. In additional embodiments, a bleed stream 126 is drawn from HPNA-reduced fractionator bottoms 122 downstream of the HPNA separation zone 120, in addition to or instead of bleed stream 118. Either or both of these bleed streams are hydrogen-rich and therefore can be effectively integrated with certain fuel oil pools, or serve as feed to fluidized catalytic cracking or steam cracking processes (not shown).

In operation of the system 100, a feedstock stream 102 and a hydrogen stream 104 are charged to the reaction zone 106. Hydrogen stream 104 contains an effective quantity of hydrogen to support the requisite degree of hydrocracking, feed type, and other factors, and can be any combination including make-up hydrogen, recycle hydrogen from optional gas separation subsystems (not shown) between reaction zone 106 and fractionating zone 110, and/or derived from fractionator gas stream 112. Reaction zone 106 operates under effective conditions for production of a reaction effluent stream 108 which contains converted, partially converted and unconverted hydrocarbons, including HPNA and/or HPNA precursor compounds formed in the reaction zone 106. One or more high pressure and low pressure separation stages can be integrated as is known to recover recycle hydrogen between the reaction zone 106 and fractionating zone 110. For example, effluents from the hydrocracking reaction vessel are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 110.

The reaction effluent stream 108 is passed to fractionating zone 110, generally to recover gas stream 112 and liquid products 114 and to separate a bottoms fraction 116 containing HPNA compounds. Gas stream 112, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactor and the fractionator (not shown), and gas stream 112 can be optional from the fractionator. One or more cracked product streams 114 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 110 can operate as one or more flash vessels to separate heavy components at a suitable cut point, for example, a range corresponding to the upper temperature range of the desired product stream 114.

In certain embodiments, all, a major portion, a significant portion, or a substantial portion of the fractionator bottoms stream 116 derived from the reaction effluent, containing HPNA compounds and/or HPNA precursors formed in the reaction zone 106, is passed to the HPNA separation zone 120 for treatment. In certain embodiments a portion of the fractionator bottoms from the reaction effluent is removed from the recycle loop as bleed stream 118. Bleed stream 118 can contain a suitable portion (V %) of the fractionator bottoms 116, in certain embodiments about 0-10, 0-5, 0-3, 1-10, 1-5 or 1-3. The concentration of HPNA compounds and/or HPNA precursors in the hydrocracking effluent fractionator bottoms is reduced in the HPNA separation zone 120 to produce the HPNA-reduced fractionator bottoms stream 122 that is recycled to the reaction zone 106. In certain embodiments, instead of or in conjunction with bleed stream 118, a portion of the HPNA-reduced fractionator bottoms stream 122 is removed from the recycle loop as bleed stream 126. Bleed stream 126 can contain a suitable portion (V %) of the HPNA-reduced fractionator bottoms stream 122, in certain embodiments about 0-10, 0-5, 0-3, 1-10, 1-5 or 1-3. A discharge stream 124 containing HPNA compounds is removed from the HPNA separation zone 120. In certain embodiments, all, a major portion, a significant portion, or a substantial portion of the HPNA-reduced fractionator bottoms stream 122 is recycled to the reaction zone 106.

In additional embodiments, one or more optional additional feeds, stream 154 can be routed to the HPNA separation zone 120. Such additional feeds can be within a similar range as the hydrocracker bottoms stream fraction and/or the initial feedstock to the system 100, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point range within about 350-800, 350-700, 350-600 or 350-565° C. For instance, the stream 154 can be in the range of about 0-100, 0-50, 10-100, 10-50, 20-100 or 20-50 V %, relative to the portion of the fractionator bottoms 116 fed to the HPNA separation zone 120. In certain embodiments the only feed to the HPNA separation zone 120 are derived from the fractionator bottoms 116.

Reaction zone 106 can contain one or more fixed-bed, ebullated-bed, slurry-bed, moving bed, continuous stirred tank (CSTR), or tubular reactors, in series and/or parallel arrangement. The reactor(s) are generally operated under conditions effective for the desired level of treatment, degree of conversion, type of reactor, the feed characteristics, and the desired product slate. In certain embodiments the reactors operate at conversion levels (V % of feed that is recovered above the unconverted oil range) in the range of 30-90, 50-90, 60-90 or 70-90. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (standard liter per liter of hydrocarbon feed (SL/L)) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. Effective catalysts used in reaction zone 106 possess hydrotreating functionality (hydrodesulfurization, hydrodenitrification and/or hydrodemetallization) and hydrocracking functionality. Hydrodesulfurization, hydrodenitrification and/or hydrodemetallization is carried out to remove sulfur, nitrogen and other contaminants, and conversion of feedstocks occurs by cracking into lighter fractions, for instance, in certain embodiments at least about 30 V % conversion.

Figure 2:
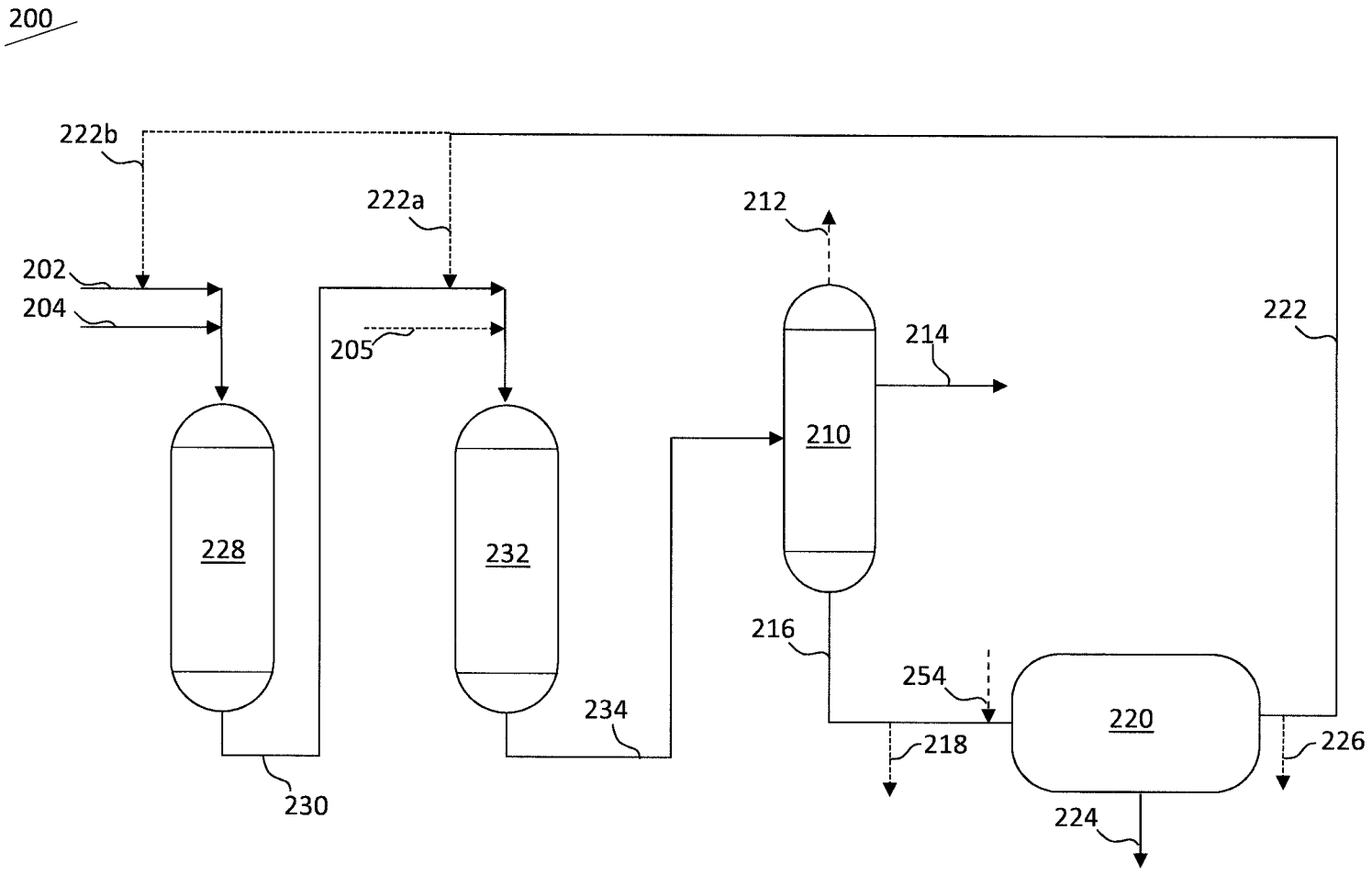
FIG. 2 is a process flow diagram of an integrated series-flow hydrocracking system.

FIG. 2 is a process flow diagram of another embodiment of an integrated hydrocracking unit operation, system 200, which operates as series-flow hydrocracking system with recycle to the first reactor zone, the second rector zone, or both the first and second reactor zones. In general, system 200 includes a first reaction zone 228, a second reaction zone 232, a fractionating zone 210, and an HPNA separation zone 220. The first reaction zone 228 generally includes one or more inlets in fluid communication with a source of initial feedstock 202, a source of hydrogen gas 204, and optionally the HPNA separation zone 220 to receive a recycle stream comprising all or a portion of the HPNA-reduced bottoms fraction 222, shown in dashed lines as stream 222*b*. The first reaction zone 228 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 228 that discharge effluent stream 230 is in fluid communication with one or more inlets of the second reaction zone 232. In certain embodiments, the effluents 230 are passed to the second reaction zone 232 without separation of any excess hydrogen and light gases. In optional embodiments, one or more high pressure and low pressure separation stages are provided between the first and second reaction zones 228, 232 for recovery of recycle hydrogen (not shown). The second reaction zone 232 generally includes one or more inlets in fluid communication with one or more outlets of the first reaction zone 228, optionally a source of additional hydrogen gas 205 and optionally the HPNA separation zone 220 to receive a recycle stream comprising all or a portion of the HPNA-reduced reaction zone bottoms fraction 222, shown in dashed lines as stream 222*a*. The second reaction zone 232 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 232 that discharge effluent stream 234 is in fluid communication with one or more inlets of the fractionating zone 210 (optionally having one or more high pressure and low pressure separation stages therebetween for recovery of recycle hydrogen, not shown). The fractionating zone 210 includes one or more outlets for discharging a distillate fraction 214 containing cracked naphtha and cracked middle distillate/diesel products and one or more outlets for discharging a bottoms fraction 216 containing unconverted oil. In certain embodiments, the fractionation zone 210 includes one or more outlets for discharging gases, stream 212, typically $H_2$, $H_2S$, $NH_3$, and light hydrocarbons ($C_1$-$C_4$).

The bottoms fraction 216 outlet is in fluid communication with one or more inlets of the HPNA separation zone 220.

In certain embodiments one or more optional additional feeds, stream 254, are in fluid communication with one or more inlets of the HPNA separation zone 220. The HPNA separation zone 220 generally includes one or more outlets for discharging HPNA-reduced fractionator bottoms portion 222 and one or more outlets for discharging a sulfonated aromatics stream 224 containing sulfonated HPNA compounds and/or sulfonated HPNA precursor compounds. The outlet discharging HPNA-reduced fractionator bottoms 222 is in fluid communication with one or more inlets of reaction zone 228 and/or 232 for recycle of all or a portion of the stream. In certain embodiments, a bleed stream 218 is drawn from bottoms 216 upstream of the HPNA separation zone 220. In additional embodiments, a bleed stream 226 is drawn from HPNA-reduced fractionator bottoms 222 downstream of the HPNA separation zone 220, in addition to or instead of bleed stream 218. Either or both of these bleed streams are hydrogen-rich and therefore can be effectively integrated with certain fuel oil pools, or serve as feed to fluidized catalytic cracking or steam cracking processes (not shown).

In operation of the system 200, a feedstock stream 202 and a hydrogen stream 204 are charged to the first reaction zone 228. Hydrogen stream 204 includes an effective quantity of hydrogen to support the requisite degree of hydrocracking, feed type, and other factors, and can be any combination including make-up hydrogen, recycle hydrogen from optional gas separation subsystems (not shown) between reaction zones 228 and 232, recycle hydrogen from optional gas separation subsystems (not shown) between reaction zone 232 and fractionator 210, and/or derived from fractionator gas stream 212. The first reaction zone 228 operates under effective conditions for production of a reaction effluent stream 230 (optionally after one or more high pressure and low pressure separation stages to recover recycle hydrogen) which is passed to the second reaction zone 232, optionally along with an additional hydrogen stream 205. The second reaction zone 232 operates under conditions effective for production of the reaction effluent stream 234, which contains converted, partially converted and unconverted hydrocarbons. The reaction effluent stream further includes HPNA compounds that were formed in the reaction zones 228 and/or 232. One or more high pressure and low pressure separation stages can be integrated as is known to recover recycle hydrogen between the reaction zone 228 and the reaction zone 232, and/or between the reaction zone 232 and fractionating zone 210. For example, effluents from the hydrocracking reaction zones 228 and/or 232 are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the next stage, that is, the second reactor 232 or the fractionating zone 210.

The reaction effluent stream 234 is passed to the fractionation zone 210, generally to recover gas stream 212 and liquid products 214 and to separate a bottoms fraction 216 containing HPNA compounds. Gas stream 212, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors, or between the reactor and the fractionator (not shown), and gas stream 212 can be optional from the fractionator. One or more cracked product streams 214 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 210 can operate as one or more flash vessels to separate heavy components at a suitable cut point, for example, a range corresponding to the upper temperature range of the desired product stream 214.

In certain embodiments, all, a major portion, a significant portion, or a substantial portion of the fractionator bottoms stream 216, containing HPNA compounds and/or HPNA precursors formed in the reaction zones, is passed to the HPNA separation zone 220 for treatment. In certain embodiments a portion of the fractionator bottoms from the reaction effluent is removed from the recycle loop as bleed stream 218. Bleed stream 218 can contain a suitable portion (V %) of the fractionator bottoms 216, in certain embodiments about 0-10, 0-5, 0-3, 1-10, 1-5 or 1-3. The concentration of HPNA compounds and/or HPNA precursors in the fractionator bottoms is reduced in the HPNA separation zone 220 to produce the HPNA-reduced fractionator bottoms stream 222. A discharge stream 224 containing HPNA compounds and/or HPNA precursors is removed from the HPNA separation zone 220. In certain embodiments, instead of or in conjunction with bleed stream 218, a portion of the HPNA-reduced fractionator bottoms stream 222 is removed from the recycle loop as bleed stream 226. Bleed stream 226 can contain a suitable portion (V %) of the HPNA-reduced fractionator bottoms stream 222, in certain embodiments about 0-10, 0-5, 0-3, 1-10, 1-5 or 1-3. In certain embodiments, all or a portion of the HPNA-reduced fractionator bottoms stream 222 is recycled to the second reaction zone 232 as stream **222*a*, the first reaction zone 228 as stream 222*b*, or both the first and second reaction zones 228 and 232. For instance, stream 222*b* comprises (V %) 0-100, 0-80 or 0-50 relative to stream 222 that is recycled to zone 228, and stream 222*a* comprises 0-100, 0-80 or 0-50 relative to stream 222 that is recycled to zone 232. In certain embodiments, all, a major portion, a significant portion, or a substantial portion of the HPNA-reduced fractionator bottoms 222 is recycled to the first reaction zone 228 as stream 222*b***.

In additional embodiments, one or more optional additional feeds, stream 254 can be routed to the HPNA separation zone 220. Such additional feeds can be within a similar range as the hydrocracked bottoms fraction and/or the initial feedstock to the system 200, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range within about 350-800, 350-700, 350-600 or 350-565° C. For instance, the stream 254 can be in the range of about 0-100, 0-50, 10-100, 10-50, 20-100 or 20-50 V %, relative to the portion of the fractionator bottoms 216 fed to the HPNA separation zone 220. In certain embodiments the only feed to the HPNA separation zone 220 are derived from the fractionator bottoms 216.

The first reaction zone 228 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 228, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the first reaction zone 228 can comprise those having hydrotreating functionality, and in certain embodiments those having hydrotreating and hydrocracking functionality. In embodiments in which catalysts used in first reaction zone 228 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30V %). In embodiments in which catalysts used in first reaction zone 228 possess hydrotreating and hydrocracking functionality, a higher degree of conversion, generally above about 30 V %, occurs.

The second reaction zone 232 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the second reaction zone 232 can comprise those having hydrocracking functionality, and in certain embodiments those having hydrocracking and hydrogenation functionality.

Figure 3:
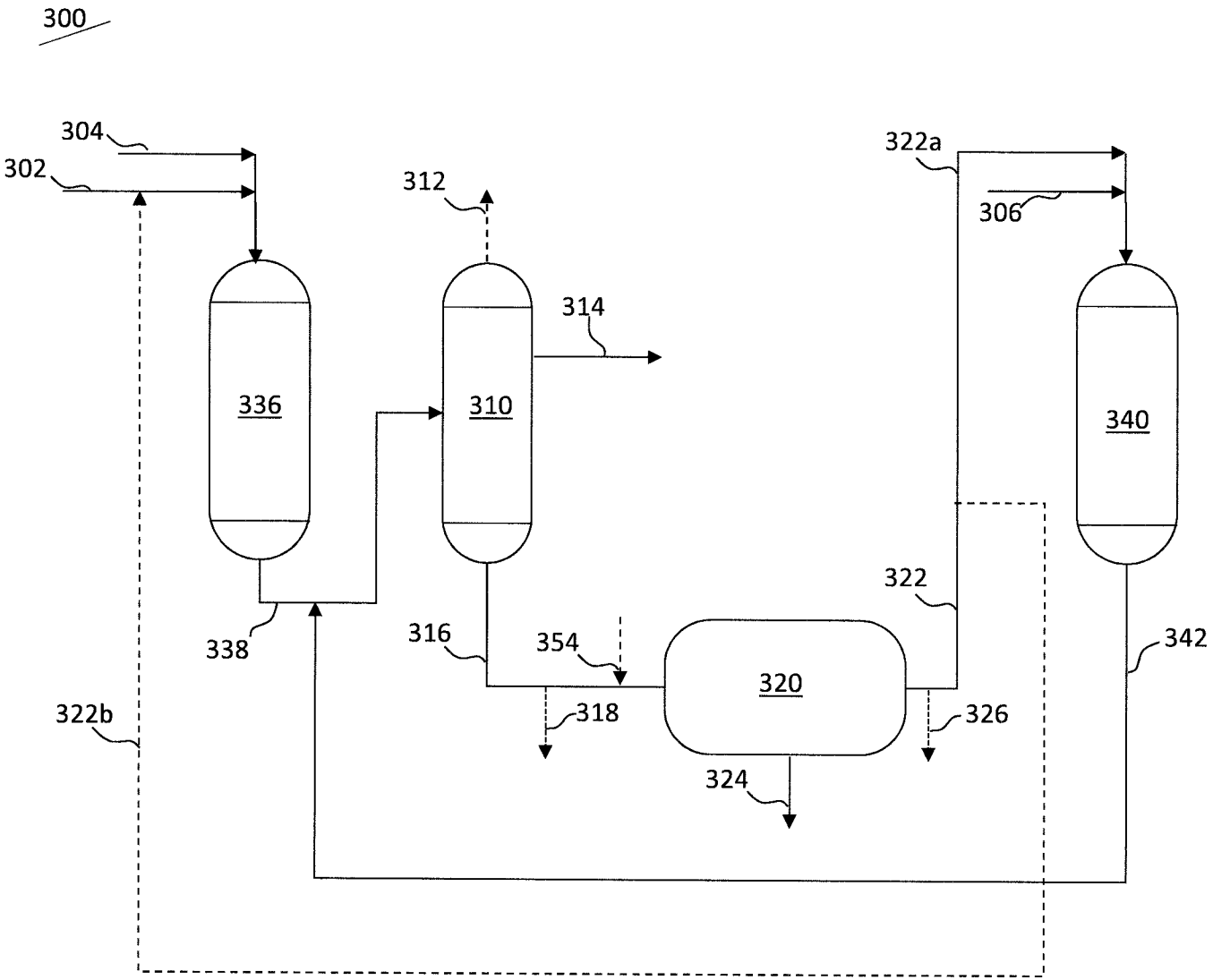
FIG. 3 is a process flow diagram of an integrated two-stage hydrocracking system with recycle.

FIG. 3 is a process flow diagram of another embodiment of an integrated hydrocracking unit operation, system 300, which operates as two-stage hydrocracking system with recycle. In general, system 300 includes a first reaction zone 336, a second reaction zone 340, a fractionating zone 310, and an HPNA separation zone 320. The first reaction zone 336 generally includes one or more inlets in fluid communication with a source of initial feedstock 302 and a source of hydrogen gas 304. The first reaction zone 336 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of treatment and conversion of the feed. One or more outlets of the first reaction zone 336 that discharge effluent stream 338 is in fluid communication with one or more inlets of the fractionating zone 310 (optionally having one or more high pressure and low pressure separation stages therebetween for recovery of recycle hydrogen, not shown). The fractionating zone 310 includes one or more outlets for discharging a distillate fraction 314 containing cracked naphtha and cracked middle distillate/diesel products; and one or more outlets for discharging a bottoms fraction 316 containing unconverted oil. In certain embodiments, the fractionation zone 310 includes one or more outlets for discharging gases, stream 312, typically Hz, $H_2S$, $NH_3$, and light hydrocarbons ($C_1$-$C_4$). The second reaction zone 340 generally includes one or more inlets in fluid communication with one or more outlets of the HPNA separation zone 320 for receiving an HPNA-reduced fractionator bottoms stream 322*a* and a source of hydrogen gas 306. The second reaction zone 340 includes an effective reactor configuration with the requisite reaction vessel(s), feed heaters, heat exchangers, hot and/or cold separators, product fractionators, strippers, and/or other units to process, and operates with effective catalyst(s) and under effective operating conditions to carry out the desired degree of additional conversion of the feed. One or more outlets of the second reaction zone 340 that discharge effluent stream 342 are in fluid communication with one or more inlets of the fractionating zone 310 (optionally having one or more high pressure and low pressure separation stages for recovery of recycle hydrogen, not shown).

The bottoms fraction 316 outlet is in fluid communication with one or more inlets of the HPNA separation zone 320. In certain embodiments one or more optional additional feeds, stream 354, are in fluid communication with one or more inlets of the HPNA separation zone 320. The HPNA separation zone 320 generally includes one or more outlets for discharging HPNA-reduced fractionator bottoms 322 and one or more outlets for discharging a sulfonated aromatics stream 324 containing sulfonated HPNA compounds and/or sulfonated HPNA precursor compounds. The outlet discharging HPNA-reduced fractionator bottoms 322 is in fluid communication with one or more inlets of the second reaction zone 340 for recycle of all or a portion 322*a* of the recycle stream 322. In certain optional embodiments, a portion 322*b*, shown in dashed lines, is in fluid communication with one or more inlets of the first reaction zone 336. In certain embodiments, a bleed stream 318 is drawn from bottoms 316 upstream of the HPNA separation zone 320. In additional embodiments, a bleed stream 326 is drawn from HPNA-reduced fractionator bottoms 322 downstream of the HPNA separation zone 320, in addition to or instead of bleed stream 318. Either or both of these bleed streams are hydrogen-rich and therefore can be effectively integrated with certain fuel oil pools, or serve as feed to fluidized catalytic cracking or steam cracking processes (not shown).

In operation of the system 300, a feedstock stream 302 and a hydrogen stream 304 are charged to the first reaction zone 336. Hydrogen stream 304 includes an effective quantity of hydrogen to support the requisite degree of hydrocracking, feed type, and other factors, and can be any combination including make-up hydrogen, recycle hydrogen from optional gas separation subsystems (not shown) between first reaction zone 336 and fractionating zone 310, recycle hydrogen from optional gas separation subsystems (not shown) between second reaction zone 340 and fractionating zone 310, and/or derived from fractionator gas stream 312. The first reaction zone 336 operates under effective conditions for production of reaction effluent stream 338. The reaction effluent stream further includes HPNA compounds that were formed in the reaction zone 336. One or more high pressure and low pressure separation stages can be integrated as is known to recover recycle hydrogen between the reaction zone 336 and the fractionating zone 310. For example, effluents from the hydrocracking reaction vessel are cooled in an exchanger and sent to a high pressure hot and/or cold separator. Separator tops are cleaned in an amine unit and the resulting hydrogen rich gas stream is passed to a recycling compressor to be used as a recycle gas in the hydrocracking reaction vessel. Separator bottoms from the high pressure separator, which are in a substantially liquid phase, are cooled and then introduced to a low pressure cold separator. Remaining gases including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. The liquid stream from the low pressure cold separator is passed to the fractionating zone 310.

The reaction effluent stream 338 is passed to the fractionation zone 310, generally to recover gas stream 312 and liquid products 314 and to separate a bottoms fraction 316 containing HPNA compounds. Gas stream 312, typically containing $H_2$, $H_2S$, $NH_3$, and light hydrocarbons ($C_1$-$C_4$), is discharged and recovered and can be further processed as is known in the art, including for recovery of recycle hydrogen. In certain embodiments one or more gas streams are discharged from one or more separators between the reactors (not shown), or between the reactor and the fractionator, and gas stream 312 can be optional from the fractionator. One or more cracked product streams 314 are discharged from appropriate outlets of the fractionator and can be further processed and/or blended in downstream refinery operations as gasoline, kerosene and/or diesel fuel products or intermediates, and/or other hydrocarbon mixtures that can be used to produce petrochemical products. In certain embodiments (not shown), fractionating zone 310 can operate as one or more flash vessels to separate heavy components at a suitable cut point, for example, a range corresponding to the upper temperature range of the desired product stream 314.

In certain embodiments, all, a major portion, a significant portion, or a substantial portion of the fractionator bottoms stream 316 containing HPNA compounds and/or HPNA precursors formed in the reaction zones is passed to the HPNA separation zone 320 for treatment. In certain embodiments a portion of the fractionator bottoms from the reaction effluent is removed as bleed stream 318. Bleed stream 318 can contain a suitable portion (V %) of the fractionator bottoms 316, in certain embodiments about 0-10, 0-5, 0-3, 1-10, 1-5 or 1-3. The concentration of HPNA compounds and/or HPNA precursors in the fractionator bottoms is reduced in the HPNA separation zone 320 to produce the HPNA-reduced fractionator bottoms stream 322. A discharge stream 324 containing HPNA compounds is removed from the HPNA separation zone 320. In certain embodiments, instead of or in conjunction with bleed stream 318, a portion of the HPNA-reduced fractionator bottoms stream 322 is removed from the recycle loop as bleed stream 326. Bleed stream 326 can contain a suitable portion (V %) of the HPNA-reduced fractionator bottoms stream 322, in certain embodiments about 0-10, 0-5, 0-3, 1-10, 1-5 or 1-3. In certain embodiments, or a portion of the HPNA-reduced fractionator bottoms stream 322 is passed to the second reaction zone 340 as stream 322*a*. In certain embodiments, all or a portion of the HPNA-reduced fractionator bottoms stream 322 is recycled to the second reaction zone 340 as stream 322*a*, the first reaction zone 336 as stream 322*b*, or both the first and second reaction zones 336 and 340. For instance, stream 322*a* comprises (V %) 0-100, 0-80 or 0-50 relative to stream 322 that is recycled to zone 340, and stream 322*b* comprises 0-100, 0-80 or 0-50 relative to stream 322 that is recycled to zone 336. In certain embodiments, all, a major portion, a significant portion, or a substantial portion of the HPNA-reduced fractionator bottoms 322 is passed to the second reaction zone 340 as stream 322*a*. The second reaction zone 340 operates under conditions effective for production of the reaction effluent stream 342, which contains converted, partially converted and unconverted hydrocarbons. The second stage the reaction effluent stream 342 is passed to the fractionating zone 310, optionally through one or more gas separators to recovery recycle hydrogen and remove certain light gases.

In additional embodiments, one or more optional additional feeds, stream 354 can be routed to the HPNA separation zone 320. Such additional feeds can be within a similar range as the hydrocracked bottoms fraction and/or the initial feedstock to the system 300, and selected from one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and generally has a boiling point in the range within about 350-800, 350-700, 350-600 or 350-565° C. For instance, the stream 354 can be in the range of about 0-100, 0-50, 10-100, 10-50, 20-100 or 20-50 V %, relative to the portion of the fractionator bottoms 316 fed to the HPNA separation zone 320. In certain embodiments the only feed to the HPNA separation zone 320 are derived from the fractionator bottoms 316.

The first reaction zone 336 can contain one or more fixed-bed, ebullated-bed, slurry-bed, moving bed, CSTR, or tubular reactors, in series and/or parallel arrangement. The reactor(s) are generally operated under conditions effective for the desired level of treatment and degree of conversion in the first reaction zone 336, the particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the first reaction zone 336 can comprise those having hydrotreating functionality, and in certain embodiments those having hydrotreating and hydrocracking functionality. In embodiments in which catalysts used in first reaction zone 336 possess hydrotreating functionality, including hydrodesulfurization, hydrodenitrification and/or hydrodemetallization, the focus is removal of sulfur, nitrogen and other contaminants, with a limited degree of conversion (for instance in the range of 10-30 V %). In embodiments in which catalysts used in first reaction zone 336 possess hydrotreating and hydrocracking functionality, a higher degree of conversion occurs, generally above about 30 V %, for instance in the range of about 30-60 V %.

The second reaction zone 340 can contain one or more fixed-bed, ebullated-bed, slurry-bed, moving bed, CSTR, or tubular reactors, in series and/or parallel arrangement. The reactor(s) are generally operated under conditions effective for the desired degree of conversion, particular type of reactor, the feed characteristics, and the desired product slate. For instance, these conditions can include a reaction temperature (° C.) in the range of from about 300-500, 300-475, 300-450, 330-500, 330-475 or 330-450; a reaction pressure (bars) in the range of from about 60-300, 60-200, 60-180, 100-300, 100-200, 100-180, 130-300, 130-200 or 130-180; a hydrogen feed rate (SL/L) of up to about 2500, 2000 or 1500, in certain embodiments from about 800-2500, 800-2000, 800-1500, 1000-2500, 1000-2000 or 1000-1500; and a feed rate liquid hourly space velocity ($h^{-1}$) in the range of from about 0.1-10, 0.1-5, 0.1-2, 0.25-10, 0.25-5, 0.25-2, 0.5-10, 0.5-5 or 0.5-2. The catalyst used in the second reaction zone 340 can comprise those having hydrocracking functionality for further conversion of refined and partially cracked components from the feedstock, and in certain embodiments those having hydrocracking and hydrogenation functionality.

Effective catalysts used in embodiments in which those possessing hydrotreating functionality required, for instance, in first reaction zone 228 or first reaction zone 336, are known. Such hydrotreating catalysts, sometimes referred to in the industry as "pretreat catalyst," are effective for hydrotreating, and inherently a limited degree of conversion occurs (generally below about 30 V %). The catalysts generally contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica or titania-silicates. Combinations of active metal components can be composed of different particles/granules containing a single active metal species, or particles containing multiple active species. For example, effective hydrotreating catalysts include one or more of an active metal component selected from the group consisting of cobalt, nickel, tungsten, molybdenum (oxides or sulfides), incorporated on an alumina support, typically with other additives. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-400, 100-350, 100-300, 150-400, 150-350, 150-300, 200-400, 200-350 or 200-300; and an average pore diameter of at least about 10, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, hydrotreating catalysts are configured in one or more beds selected from nickel/tungsten/molybdenum, cobalt/molybdenum, nickel/molybdenum, nickel/tungsten, and cobalt/nickel/molybdenum. Combinations of one or more beds of nickel/tungsten/molybdenum, cobalt/molybdenum, nickel/molybdenum, nickel/tungsten and cobalt/nickel/molybdenum, are useful for difficult feedstocks such as demetallized oil, and to increase hydrocracking functionality. In additional embodiments, the catalyst includes a bed of cobalt/molybdenum catalysts and a bed of nickel/molybdenum catalysts.

Effective catalysts used in embodiments where those possessing hydrotreating and hydrocracking functionality are required, for instance, reaction zone 106, first reaction zone 228 or first reaction zone 336, are known. These catalysts, effective for hydrotreating and a degree of conversion generally in the range of about 30-60 V %. contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrotreating/hydrocracking catalysts include one or more of an active metal component selected from the group consisting of cobalt, nickel, tungsten, molybdenum (oxides or sulfides), incorporated on acidic alumina, silica alumina, zeolite or a combination thereof. In embodiments in which zeolites are used, they are conventionally formed with one or more binder components such as alumina, silica, silica-alumina and mixtures thereof. In certain embodiments in which an objective is hydrodenitrification and treatment of difficult feedstocks such as demetallized oil, the supports are acidic alumina, silica alumina or a combination thereof. In embodiments in which the objective is hydrodenitrification increases hydrocarbon conversion, the supports are silica alumina, or a combination thereof. Silica alumina is useful for difficult feedstocks for stability and enhanced cracking. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In certain embodiments, one or more beds are provided in series in a single reactor or in a series of reactors. For instance, a first catalyst bed containing active metals on silica alumina support is provided for hydrodenitrogenation, hydrodesulfurization and hydrocracking functionalities, followed by a catalyst bed containing active metals on zeolite support for hydrocracking functionality.

Effective catalysts used in embodiments where those possessing hydrocracking functionality, for instance, second reaction zone 232 or second reaction zone 340, are known. These catalysts, effective for further conversion of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as silica-alumina, silica, titania, titania-silica, titania-silicates, or zeolites. Combinations of active metal components can be composed of different particles/granules containing a single active metal species, or particles containing multiple active species. In embodiments in which zeolites are used, they are conventionally formed with one or more binder components such as alumina, silica, silica-alumina and mixtures thereof. For example, effective hydrocracking catalysts include one or more of an active metal component selected from the group consisting of nickel, tungsten, molybdenum (oxides or sulfides), incorporated on acidic alumina, silica alumina, zeolite or a combination thereof. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-500, 100-450, 180-900, 180-500, 180-450, 200-900, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalysts) 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In a typical hydrocracking reaction scheme, the main cracking catalyst bed or beds are followed by post treat catalyst to remove mercaptans formed during hydrocracking. Typical supports for post treat catalyst are silica-alumina, zeolites of combination thereof.

Effective catalysts used in embodiments where those possessing hydrocracking and hydrogenation functionality, for instance, second reaction zone 232 or second reaction zone 340, are known. These catalysts, effective for further conversion and also for hydrogenation of refined and partially cracked components from the feedstock, contain one or more active metal components of metals or metal compounds (oxides or sulfides) selected from the Periodic Table of the Elements IUPAC Groups 6, 7, 8, 9 and 10. One or more active metal component(s) are typically deposited or otherwise incorporated on a support, which can be amorphous and/or structured, such as alumina, silica-alumina, silica, titania, titania-silica, titania-silicates, or zeolites. Combinations of active metal components can be composed of different particles/granules containing a single active metal species, or particles containing multiple active species. For example, effective hydrocracking catalysts include one or more of an active metal component selected from the group consisting of cobalt, nickel, tungsten, molybdenum (oxides), incorporated on acidic alumina, silica alumina, zeolite or a combination thereof. In certain embodiments, the catalyst particles have a pore volume in the range of about (cc/gm) 0.15-1.70, 0.15-1.50, 0.30-1.50 or 0.30-1.70; a specific surface area in the range of about ($m^2/g$) 100-900, 100-800, 100-500, 100-450, 180-900, 180-800, 180-500, 180-450, 200-900, 200-800, 200-500 or 200-450; and an average pore diameter of at least about 45, 50, 100, 200, 500 or 1000 angstrom units. The active metal component(s) are incorporated in an effective concentration, for instance, in the range of (wt % based on the mass of the oxides, sulfides or metals relative to the total mass of the catalyst) 0.01-40, 0.01-30, 0.01-10, 0.01-5, 1-40, 1-30, 1-10, 1-5, 2-40, 2-30, 2-10, 3-40, 3-30 or 3-10. In certain embodiments, the active metal component(s) include one or more of cobalt, nickel, tungsten and molybdenum, and effective concentrations are based on all the mass of active metal components on an oxide basis. In embodiments in which one or more upstream reaction zone(s) reduces contaminants such as sulfur and nitrogen, so that hydrogen sulfide and ammonia are minimized in the reaction zone, active metal components effective as hydrogenation catalysts can include one or more noble metals such as platinum, palladium or rhodium, alone or in combination with other active metals such as nickel. Such noble metals can be provided in the range of (wt % based on the mass of the metal relative to the total mass of the catalyst) 0.01-5, 0.01-2, 0.05-5, 0.05-2, 0.1-5, 0.1-2, 0.5-5, or 0.5-2.

In certain embodiments, the catalyst and/or the catalyst support is prepared in accordance with U.S. Pat. No. 9,221,036 and related U.S. Pat. No. 10,081,009 (jointly owned by the owner of the present application), which are incorporated herein by reference in their entireties, includes a modified USY zeolite support having one or more of Ti, Zr and/or Hf substituting the aluminum atoms constituting the zeolite framework thereof.

In embodiments described herein using zeolite-based hydrocracking catalysts, HPNA compounds have relatively greater tendency to accumulate in the recycle stream due to the inability for these larger molecules to diffuse into the catalyst pore structure, particularly at relatively lower hydrogen partial pressure levels in the reactor. For instance, at hydrogen partial pressures less than about 100 bars, HPNA formation is known to reduce catalyst lifecycle to by 30-70% depending upon the feedstock processed and targeted conversion rate. However, according to the process herein, by removing HPNA compounds from the recycle stream, the lifecycle of such zeolite catalyst is increased.

The HPNA separation zones 120, 220 and 320 integrated in hydrocracking systems 100, 200 and 300 described herein, and variations thereto apparent to a person having ordinary skill in the art, are effective for removal of HPNA compounds and/or HPNA precursor compounds from a hydrocracker bottoms stream. The hydrocracker bottoms fraction contains HPNA compounds and/or HPNA precursor compounds that were formed in the reaction zones, and are treated in the HPNA separation zone to produce the reduced-HPNA hydrocracked bottoms fraction. In certain embodiments, a major portion, a significant portion, or a substantial portion of HPNA compounds are removed from the hydrocracker bottoms stream by contact with a sulfonation agent followed by separation of sulfonated aromatics from the remaining hydrocarbons.

In accordance with the various embodiments herein, hydrocracked bottoms fractions containing HPNA compounds and/or HPNA precursor compounds are contacted with an effective quantity of sulfonation agent. In general, in sulfonation reactions, a hydrogen atom in an aromatic hydrocarbon is replaced with a sulfonic acid group, to thereby produce aromatic sulfonates. The mixture of the unreacted bottoms components and aromatic sulfonates form a sulfonated hydrocracked bottoms fraction. The bottoms fraction is mostly naphthenic and paraffinic, and in operation of the process herein, aromatics are sulfonated.

The sulfonated hydrocracked bottoms containing aromatic sulfonates can be separated into an HPNA-reduced hydrocracked bottoms portion and a sulfonated HPNA portion by contacting with a solvent under conditions effective for phase separation into a solvent phase containing the dissolved sulfonated hydrocracked bottoms, and the reduced-HPNA oil phase. In certain embodiments the solvent is water or aqueous based to effectively separate the sulfonated hydrocracked bottoms containing aromatic sulfonates into an aqueous phase containing water soluble sulfonated HPNA compounds and/or HPNA precursor compounds, and the reduced-HPNA oil phase.

Figure 4:
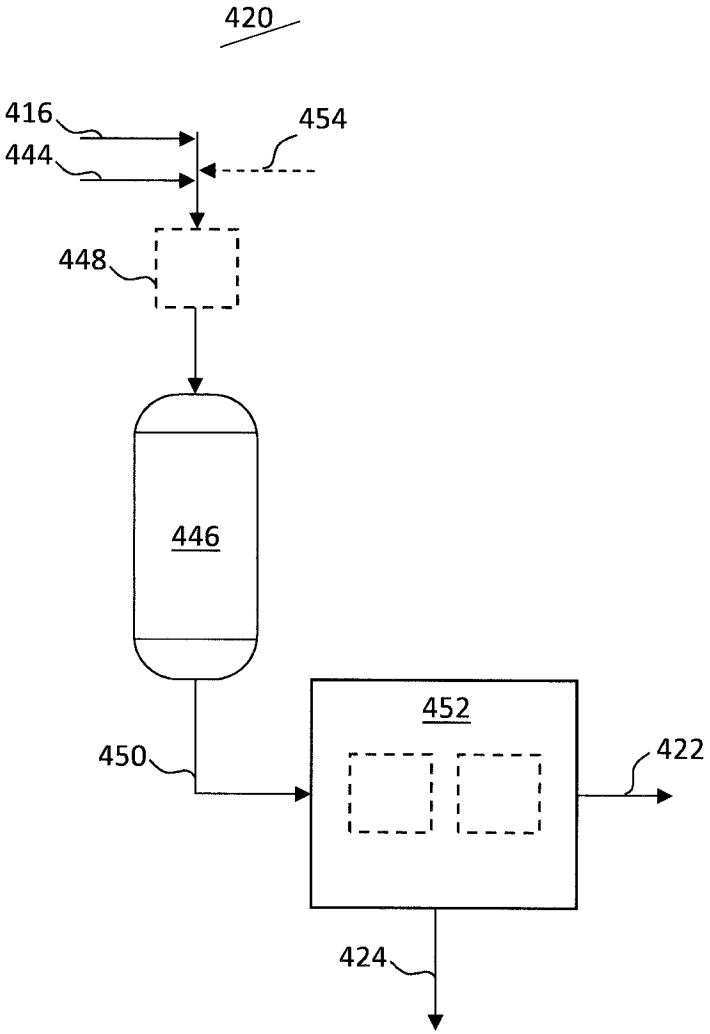
FIG. 4 is a process flow diagram of an embodiment of sulfonation and separation of HPNA compounds from a hydrocracker bottoms stream, generally showing removal of sulfonated HPNA compounds.

For instance, referring to FIG. 4, a method for separation of HPNA compounds and/or HPNA precursor compounds from a hydrocracked bottoms fraction is shown. A hydrocracked bottoms fraction is contacted with an effective quantity of sulfonation agent to promote reaction with HPNA and/or HPNA precursor compounds and to produce corresponding aromatic sulfonates and form a sulfonated hydrocracked bottoms fraction. The sulfonated hydrocracked bottoms fraction is separated into an HPNA-reduced hydrocracked bottoms portion and a sulfonated HPNA portion.

An HPNA separation zone 420 generally includes a sulfonation reaction zone 446 and a separation zone 452. The sulfonation reaction zone 446 includes one or more inlets for receiving a feed comprising or consisting of a hydrocracked bottoms fraction 416 (for instance corresponding to all, a substantial portion, a significant portion, or a major portion of streams 116, 216 or 316 above) containing HPNA compounds, and one or more inlets for receiving a source of sulfonation agent 444, and optionally catalyst. In certain embodiments, an optional feed 454 is also charged to the sulfonation reaction zone 446, which can be one or more feedstreams similar to the feed to the hydrocracking operation, or can be a portion of the feed to the hydrocracking operation, for instance, similar to streams 154, 254 and 354 described above. A contacting and/or mixing zone 448 is optionally included upstream of reaction zone 446 to promote intimate mixing of oil and sulfonation agent.

The source 444 provides an effective concentration of sulfonation agent. The sulfonation agents can be a liquid phase solution such as sulfuric acid. In additional embodiments, a gas phase sulfonation agent is used, for instance, selected from the group consisting of $SO_2$, $SO_3$ and mixtures thereof. Other aspects of gas phase sulfonation are described herein with respect to FIGS. 6A, 6B and 6C.

Reaction products 450, which include aromatic sulfonates formed in the reaction zone 446 including sulfonated HPNA compounds and/or sulfonated HPNA precursor compounds, other sulfonated hydrocarbons, and the remaining hydrocarbons, are phase separated in a separation zone 452. Separation zone generally includes one or more aqueous phase separation steps in series and/or parallel arrangement. For instance, the mixture 450 contains and/or is mixed with an effective quantity of aqueous solvent, such as water, and is passed to a phase separation vessel. Aqueous solvent extraction operations can be carried out in one or more settler vessels, a stage-type extractor such as a mixer-settler apparatus or a centrifugal contactor, or a differential extractor including but not limited to multiple stage centrifugal contactors or contacting columns such as tray columns, spray columns, packed towers, rotating disc contactors or pulse columns.

An HPNA-reduced hydrocracked bottoms fraction is discharged as effluent 422 (for instance corresponding to streams 122, 222 or 322 above), and a sulfonated aromatics stream containing HPNA compounds is discharged as stream 424 (for instance corresponding to streams 124, 224 or 324 above).

Reaction zone 446 can contain one or more suitable reactors such as fixed-bed, ebullated-bed, slurry-bed, moving bed, continuous stirred tank, or tubular reactors, and/or one or more suitable liquid-liquid contactor columns, tray columns, spray columns, packed towers, rotating disc contactors, pulse columns, in series and/or parallel arrangement. The reactor(s) are generally operated under conditions effective for the particular type of reactor, the feed characteristics, and the desired sulfonation conversion, and to promote reaction with HPNA and/or HPNA precursor aromatic compounds to produce corresponding aromatic sulfonates and form a sulfonated hydrocracked bottoms fraction.

Effective operating conditions in processes using liquid phase sulfonation agent can include a reaction temperature (° C.) in the range of from about 0-150, 0-100, 0-80, 20-150, 20-100 or 20-80;

a reaction pressure (bars) in the range of from about 1-30, 1-10 or 1-5;

a sulfonation agent to aromatic carbon containing compounds (molar ratio) of from about 1:1-15:1, 1:1-10:1, 1:1-5:1, 4:1-15:1, 4:1-10:1, or 4:1-5:1; and a feed rate liquid hourly space velocity based on the volume of the reactor ($h^{-1}$) in the range of from about 0.5-20, 0.5-10, 0.5-5, 0.5-2, 1-20, 1-10, 1-5 or 1-2.

Effective operating conditions in processes using gas phase sulfonation agent can include a reaction temperature (° C.) in the range of from about 20-600, 150-600, 20-550, 150-550, 20-500, 150-500, 200-600, 200-550, 200-500, 300-600, 300-550 or 300-550;

a reaction pressure (bars) in the range of from about 0.01 (vacuum)-100, 0.01-50, 0.01-30, 0.01-5, 0.35 (vacuum)-100, 0.35-50, 0.35-30, 0.35-5, 1-100, 1-50, 1-30 or 1-5;

a sulfonation agent to aromatic carbon containing compounds (molar ratio) of from about 1:1-15:1, 1:1-10:1, 1:1-5:1, 4:1-15:1, 4:1-10:1, or 4:1-5:1; and a feed rate gas hourly space velocity based on the volume of the reactor ($h^{-1}$) in the range of from about 0.5-20, 0.5-10, 0.5-5, 0.5-2, 1-20, 1-10, 1-5 or 1-2.

Figure 5:
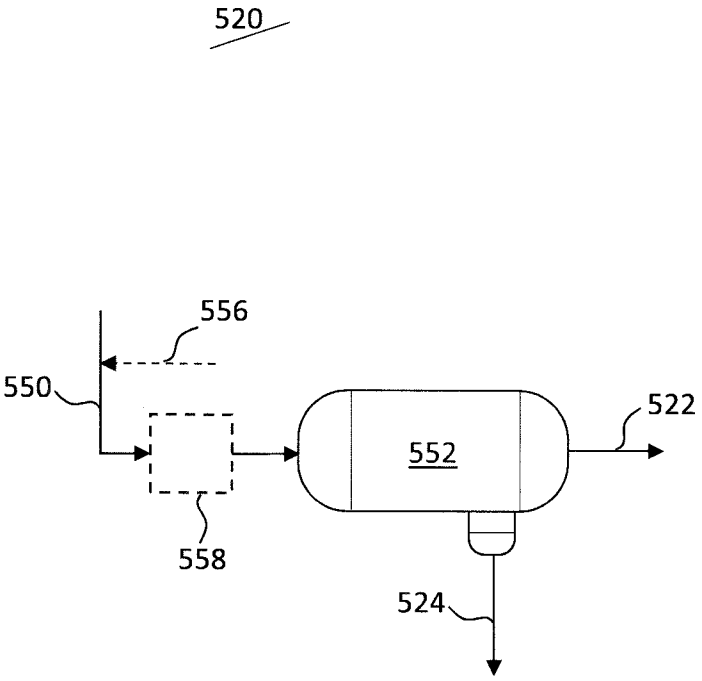
FIG. 5 is a process flow diagram of an embodiment of sulfonation and separation of HPNA compounds from a hydrocracker bottoms, showing removal of sulfonated HPNA compounds by aqueous separation.

Referring to FIG. 5, a method for separation of HPNA from a hydrocracked bottoms fraction is shown. A hydrocracked bottoms fraction is contacted with an effective quantity of sulfonation agent under reaction conditions suitable to sulfonate HPNA and/or HPNA precursor aromatic compounds, as described above with respect to reaction zone 446. Corresponding aromatic sulfonates are produced, and a sulfonated hydrocracked bottoms fraction is recovered. The sulfonated hydrocracked bottoms fraction is separated into an HPNA-reduced hydrocracked bottoms fraction and a sulfonated HPNA portion. The sulfonated hydrocracked bottoms fraction contains and/or is mixed with an effective quantity of aqueous solvent, such as water, to dissolve aromatic sulfonates and form an oil phase containing the HPNA-reduced recycle stream and an aqueous phase containing dissolved aromatic sulfonates. The oil and aqueous phases are phase separated to recover an HPNA-reduced hydrocracked bottoms fraction and an aqueous phase stream containing dissolved aromatic sulfonates.

In one embodiment, reaction products 550, which include aromatic sulfonates formed in the sulfonation reaction zone including sulfonated HPNA compounds and/or sulfonated HPNA precursor compounds, other sulfonated hydrocarbons, and the remaining hydrocarbons, are phase separated in a separation zone 552. An HPNA-reduced hydrocracked bottoms fraction is discharged as effluent 522 (for instance corresponding to streams 122, 222 or 322 above), and a sulfonated aromatics stream containing HPNA compounds is discharged as stream 524 (for instance corresponding to streams 124, 224 or 324 above). Separation zone 552 can contain one or more suitable separation operations in series and/or parallel arrangement effective for aqueous-oil phase separation. In additional embodiments, an optional mixing zone 558 can be included upstream of the separation zone 552.

In embodiments in which there is sufficient water in the reaction products 550, the mixture can be sent to the separation zone 552, optionally via the mixing zone 558, without additional water. For instance, in certain embodiments the sulfonation agent is an aqueous liquid, such as a sulfuric acid solution, with sufficient water for phase separation. In embodiments in which the sulfonation agent is gaseous or non-aqueous, or in embodiments operating with liquid sulfonation agent and where additional water is need, an effective quantity of water or additional water 556 can be added to the reaction product 550 to dissolve the sulfonated HPNA and/or sulfonated HPNA precursor compounds. Note that the water or additional water 556 can be added to the reaction product 550 as shown, to the separation zone 552, and/or to the optional mixing zone 558. For instance, an effective quantity of additional water can be up to about 50, 30, 20, 10 or 5 V % relative to the oil volume, and as low as about 1 V % or even lower since HPNA concentrations are relatively low. The quantity of water can be added so that the total water content is equivalent to the content of the sulfonated HPNA and/or HPNA precursor compounds in the reaction product 550. Excess water is often used, and is removed as necessary after separation.

In aqueous-oil phase separation, the reaction product 550 is maintained in one or more two phase liquid separator vessels under conditions effective for the aqueous phase 524 containing sulfonated HPNA compounds to separate from the oil phase 522 containing an HPNA-reduced hydrocracked bottoms fraction. For instance, these conditions can include a vessel temperature (° C.) in the range of from about 20-150, 20-75, 20-60, 30-150, 30-75, 30-60, 45-150, 45-75 or 45-60; a vessel pressure (bars) in the range of from about 1-10, 1-5 or 1-3; and residence time (minutes) in the range of from about 1-100, 1-60, 1-30, 15-100, 15-60 or 15-30. In certain embodiments, some unreacted HPNA and/or HPNA precursor compounds pass with aqueous phase stream 524 and/or the oil phase stream 522, and some of the sulfonated HPNA and/or HPNA precursor compounds, for instance no more than a minor portion, pass with the oil phase 522. Any water remaining in the oil phase stream 522 can be removed as is known prior to recycling, or in certain embodiments prior to further separation of sulfonated HPNA and/or HPNA precursor compounds, for instance by solvent extraction. In addition, any oil remaining in the aqueous phase stream 524 can be removed and recovered as is known, for instance prior to recycling or treatment.

In certain embodiments, sulfonated HPNA and/or HPNA precursor compounds are separated from the sulfonation reactor effluent by selective aromatic extraction. Selective aromatic extraction can be carried out as the primary manner of separation of sulfonated HPNA and/or HPNA precursor compounds, after aqueous phase separation, or before aqueous phase separation.

For instance, aromatic separation apparatus can be a suitable solvent extraction separation apparatus capable of partitioning the sulfonated hydrocracked bottoms fraction into a reduced HPNA feed for recycle or further hydrocracking from the raffinate phase, and a sulfonated HPNA byproduct from the extract phase. As is known, some unreacted HPNA and/or HPNA precursor compounds passing with the raffinate and/or extract, and some of the sulfonated HPNA and/or HPNA precursor compounds, for instance no more than a minor portion, pass with the reduced HPNA stream derived from the raffinate.

The solvent, operating conditions, and the mechanism of contacting the solvent and feed permit control over the level of aromatic extraction. For instance, suitable aromatic selective solvents include furfural, N-methyl-2-pyrrolidone, dimethylformamide, dimethylsulfoxide, phenol, nitrobenzene, sulfolanes, acetonitrile, furfural, or glycols and can be provided in a solvent to oil ratio of about 20:1, in certain embodiments about 4:1, and in further embodiments about 1:1. Suitable glycols include diethylene glycol, ethylene glycol, triethylene glycol, tetraethylene glycol and dipropylene glycol. The extraction solvent can be a pure glycol or a glycol diluted with from about 2 to 10 W % water. Suitable sulfolanes include hydrocarbon-substituted sulfolanes (e.g., 3-methyl sulfolane), hydroxy sulfolanes (e.g., 3-sulfolanol and 3-methyl-4-sulfolanol), sulfolanyl ethers (e.g., methyl-3-sulfolanyl ether), and sulfolanyl esters (e.g., 3-sulfolanyl acetate). The aromatic extraction vessels can operate at a temperature in the range of from about 20° C. to 200° C., and in certain embodiments from about 40° C. to 80° C. The operating pressure of the aromatic separation apparatus can be in the range of from about 1 bar to 10 bars, and in certain embodiments from about 1 bar to 3 bars. Types of extraction vessels useful as the aromatic separation apparatus in certain embodiments of the system and process described herein include stage-type extractors or differential extractors.

Examples of stage-type extractors are mixer-settler apparatus or centrifugal contactors. Various types of differential extractors (also known as "continuous contact extractors,") that are also suitable for use as an extraction apparatus include, but are not limited to, multiple stage centrifugal contactors and contacting columns such as tray columns, spray columns, packed towers, rotating disc contactors and pulse columns.

Figure 6A:
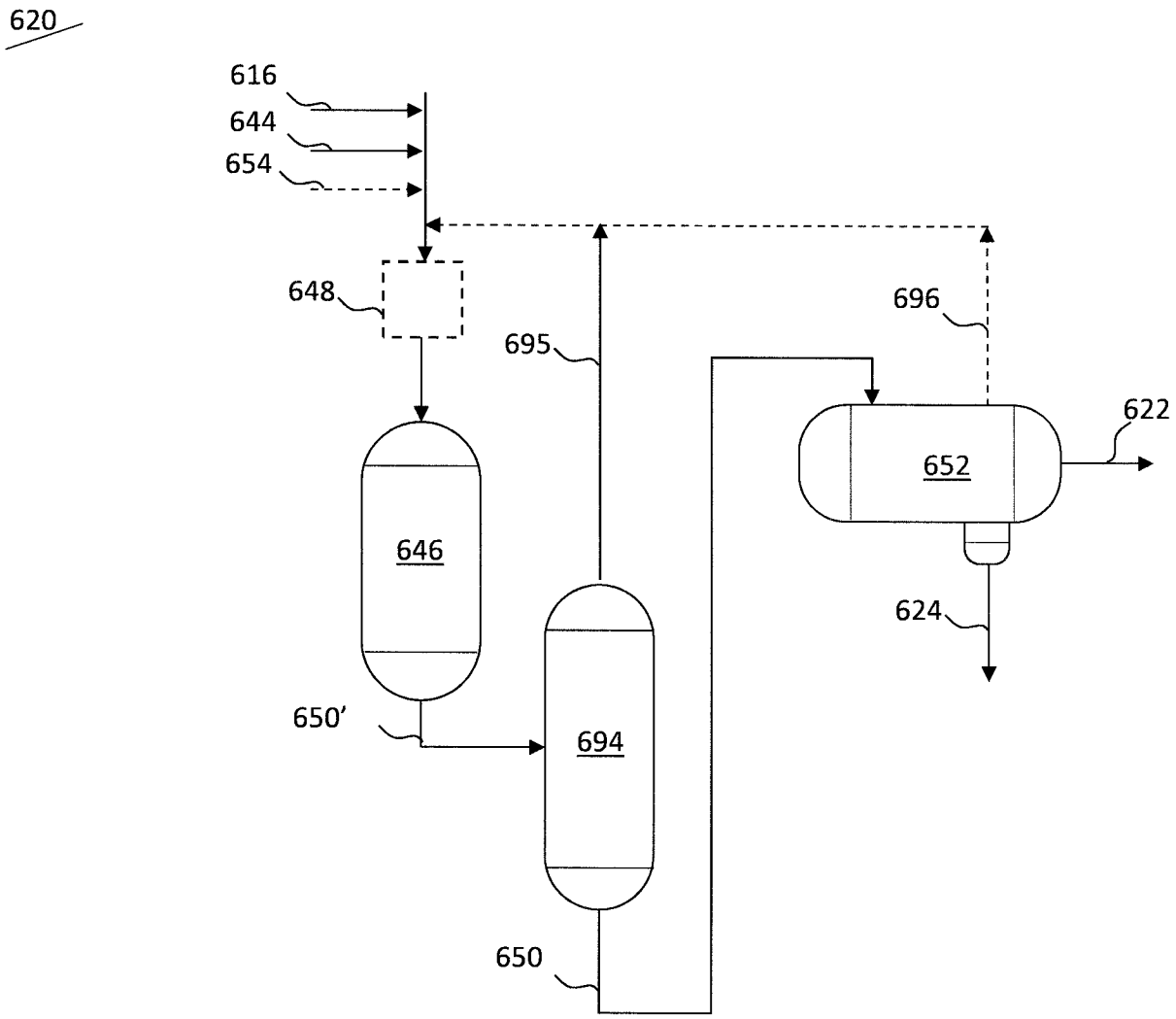
FIG. 6A is a process flow diagram of another embodiment of sulfonation and separation of HPNA compounds from a hydrocracker bottoms by gas phase sulfonation.
Figure 6C:
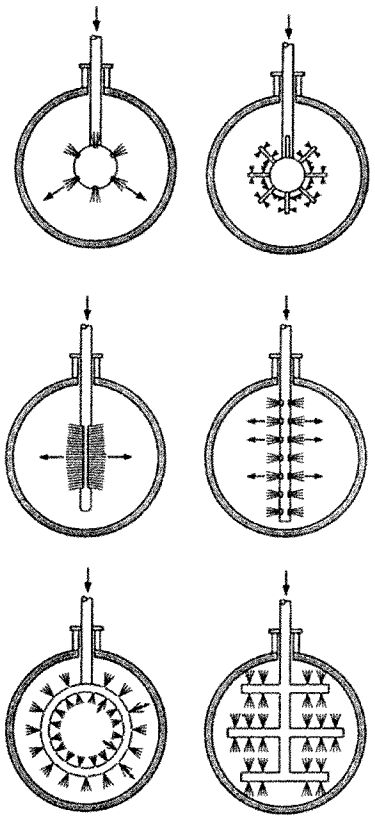
FIG. 6C are schematic diagrams of gas distributors suitable for use with gaseous sulfonation agent dissolving operations compatible with the process of FIGS. 6A-6B.
Figure 6B:
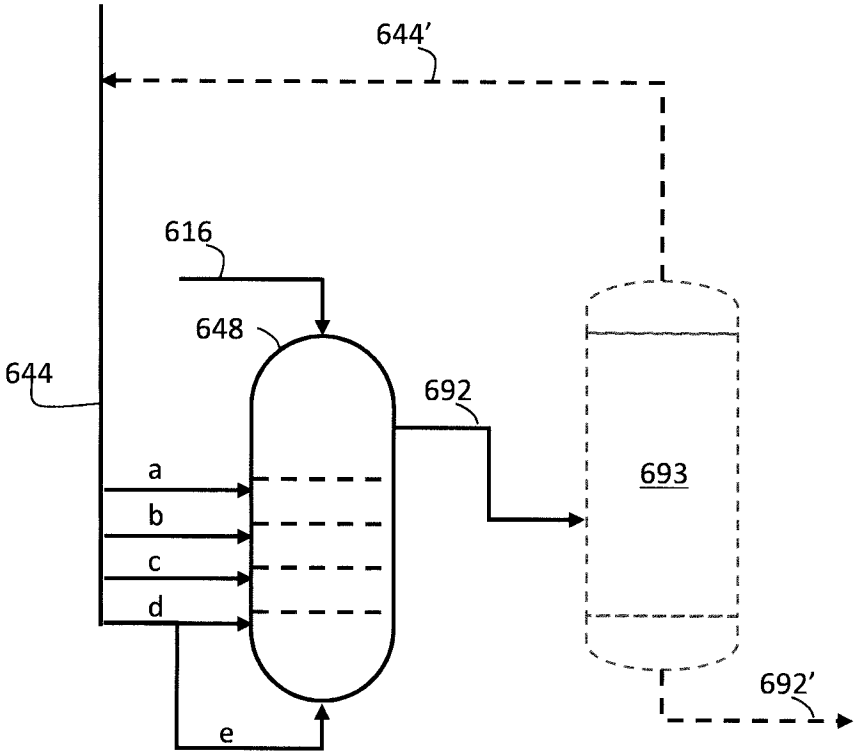
FIG. 6B is a schematic diagram of a dissolving system for a gaseous sulfonation agent compatible with the process of FIG. 6A.

Referring to FIG. 6A, another method for separation of HPNA from a hydrocracked bottoms fraction is shown. A hydrocracked bottoms fraction is contacted with an effective quantity of gas phase sulfonation agent and optionally an effective quantity of catalyst under reaction conditions suitable to sulfonate HPNA compounds and form a sulfonated hydrocracked bottoms fraction. In certain embodiments an excess gas phase sulfonation agent is removed and optionally recycled to the contacting step. The sulfonated hydrocracked bottoms fraction is separated into an HPNA-reduced hydrocracked bottoms fraction and a sulfonated HPNA portion.

In one embodiment, an HPNA separation zone 620 operates similar in some respects to HPNA separation zone 420 described herein in conjunction with FIG. 4. A hydrocracked bottoms fraction 616 containing HPNA compounds and a source of gaseous sulfonation agent 644 is in fluid communication with a reaction zone 646. In certain embodiments, an optional feed 654 is also charged to the sulfonation reaction zone 646. A contacting and/or mixing zone 648 is optionally included, particularly in embodiments in which the reaction zone is designed to operate as a two-phase system including a solid catalyst phase and a liquid phase containing dissolved sulfonation agent. The contacting and/or mixing zone 648 can be provided upstream of reaction zone 646 to promote intimate mixing of oil, sulfonation agent, and optionally catalyst.

The optional mixing zone in the herein processes can be a suitable apparatus that achieves the necessary intimate mixing of the substantially liquid feedstock and gas so that sufficient gaseous sulfonation agent is dissolved in the liquid recycle bottoms. In other embodiments, the mixing zone can include a combined inlet for the gaseous sulfonation agent and the feedstock. Effective unit operations include one or more gas-liquid distributor vessels, which apparatuses can include spargers, injection nozzles, or other devices that impart sufficient velocity to inject the gaseous sulfonation agent into the liquid hydrocarbon with turbulent mixing and thereby promote gas saturation into the feed. Suitable apparatus are described with respect to FIGS. 6B and 6C herein. In certain embodiments, such as, for example, shown in FIG. 6B, a column is used as a gas distributor vessel 648, in which gaseous sulfonation agent 644 is injected at plural locations a, b, c, d and e. Gaseous sulfonation agent is injected through distributors into the vessel for adequate mixing to effectively dissolve gaseous sulfonation agent in the feedstock. For instance, suitable injection nozzles can be provided proximate several plates (locations a-d) and also at the bottom of the column (location e). The hydrocracked bottoms fraction 616 (or combination of the hydrocracked bottoms fraction 616 and another feedstock 654) can be fed from the bottom or top of the column.

In certain embodiments, the effluent 692 is a mixture of hydrocracked bottoms fraction having sulfonation agent dissolved therein and a very small amount of excess gas, so that at least all, a substantial portion, a significant portion, or a major portion of the mixture 692 is in liquid phase, and serves as the sulfonation agent-enhanced hydrocracked bottoms fraction is passed to the sulfonation reaction zone 646. In other embodiments, the effluent 692 is a mixture of hydrocracked bottoms fraction having sulfonation agent dissolved therein, and excess gas that is flashed off in an optional gas separation unit 693, and the sulfonation agent-enhanced hydrocracked bottoms fraction 692' is passed to the sulfonation reaction zone 646; gaseous sulfonation agent can optionally be recycled as stream 644'.

Various types of distributor apparatus can be used. For instance, referring to FIG. 6C, gas distributors can include tubular injectors fitted with nozzles and/or jets that are configured to uniformly distribute gaseous sulfonation agent into the flowing hydrocarbon feedstock in a column or vessel in order to achieve a saturation state in the mixing zone. Note that the mixing zone is not required when the system operates as a three-phase system, including gaseous sulfonation agent, liquid recycle bottoms and solid catalyst.

The reaction products 650' can include excess gaseous sulfonation agent. Accordingly, in certain embodiments, reaction products 650' containing excess gaseous sulfonation agent is passed to a gas recovery zone 694. A gas stream 695 containing excess sulfonation agent from gas recovery zone 694 is removed. The recovered excess gaseous sulfonation agent 695 is optionally recycled to the reaction zone 646 or the contacting and/or mixing zone 648. Reaction products 650, which include sulfonated aromatics formed in the reaction zone 646, and the remaining hydrocarbons, are passed to a separation zone 652 to obtain an HPNA-reduced hydrocracked bottoms fraction 622 (for instance corresponding to streams 122, 222 and 322 above), and a sulfonated HPNA phase 624 (for instance corresponding to streams 124, 224 and 324 above). In addition, in embodiments in which excess gas phase sulfonation agent remains in the reaction product stream 650, a gas stream 696 can optionally be recovered from the separation zone 652. If recovered, gas stream 696 can be compressed (not shown) and recycled to the reaction zone 646 or the contacting and/or mixing zone 648. Separation zone 652 can be any of the previously described separation processes or combination thereof, including an aqueous separation process described with respect to FIG. 5.

Gas recovery zone 694 can contain one or more strippers, flash separation vessels and/or distillation columns. The gas recovery units are generally operated under conditions compatible with the reactor effluents. For example, a gas recovery zone 694 downstream of a high temperature reactor system can operate at a temperature in the range of about 200° C. to 300° C. and a pressure in the range of from about 1-10 or 3-5 bars. A gas recovery zone 694 downstream of a low temperature reactor system can operate at a temperature in the range of about 40° C. to 100° C. and a pressure in the range of from about 1-10 or 3-5 bars.

Reaction zone 646 can contain one or more suitable reactors such as fixed-bed, ebullated-bed, slurry-bed, moving bed, continuous stirred tank, fluidized bed, or tubular reactors, in series and/or parallel arrangement. The reactor(s) are generally operated under conditions effective for the particular type of reactor, the feed characteristics, and the desired sulfonation conversion, and to promote reaction with aromatics to produce aromatic sulfonates and form a sulfonated hydrocracked bottoms fraction, as noted herein.

The source of sulfonation agent 644 contains an effective concentration of gas phase sulfonation agent(s) such as $SO_2$, $SO_3$ and mixtures thereof. Sulfonation reactions can occur in the presence or absence of catalyst. In addition, one or more co-catalysts or phase transfer agents can be included, such as acetic acid. In certain embodiments phase transfer agents are provided to facilitate the biphasic reaction.

In certain embodiments, sulfonation catalysts used in the reaction zones described herein, for instance, zones 446, 646. For example metal complexes are suitable to enhance sulfonation reactions, including but not limited to copper sulfate, mercury sulfate, vanadium pentaoxide, sodium sulfate, chromic acid, potassium sulfate, lithium sulfate or combination thereof. In embodiments in which they are used, sulfonation catalyst can be added to the sulfuric acid at effective concentrations of about 0-5000, 0-2500, 0-1000, 50-5000, 50-2500, 50-1000, 100-5000, 100-2500, 100-1000, 500-5000, 500-2500 or 500-1000 ppmw.

Example

Figure 7:
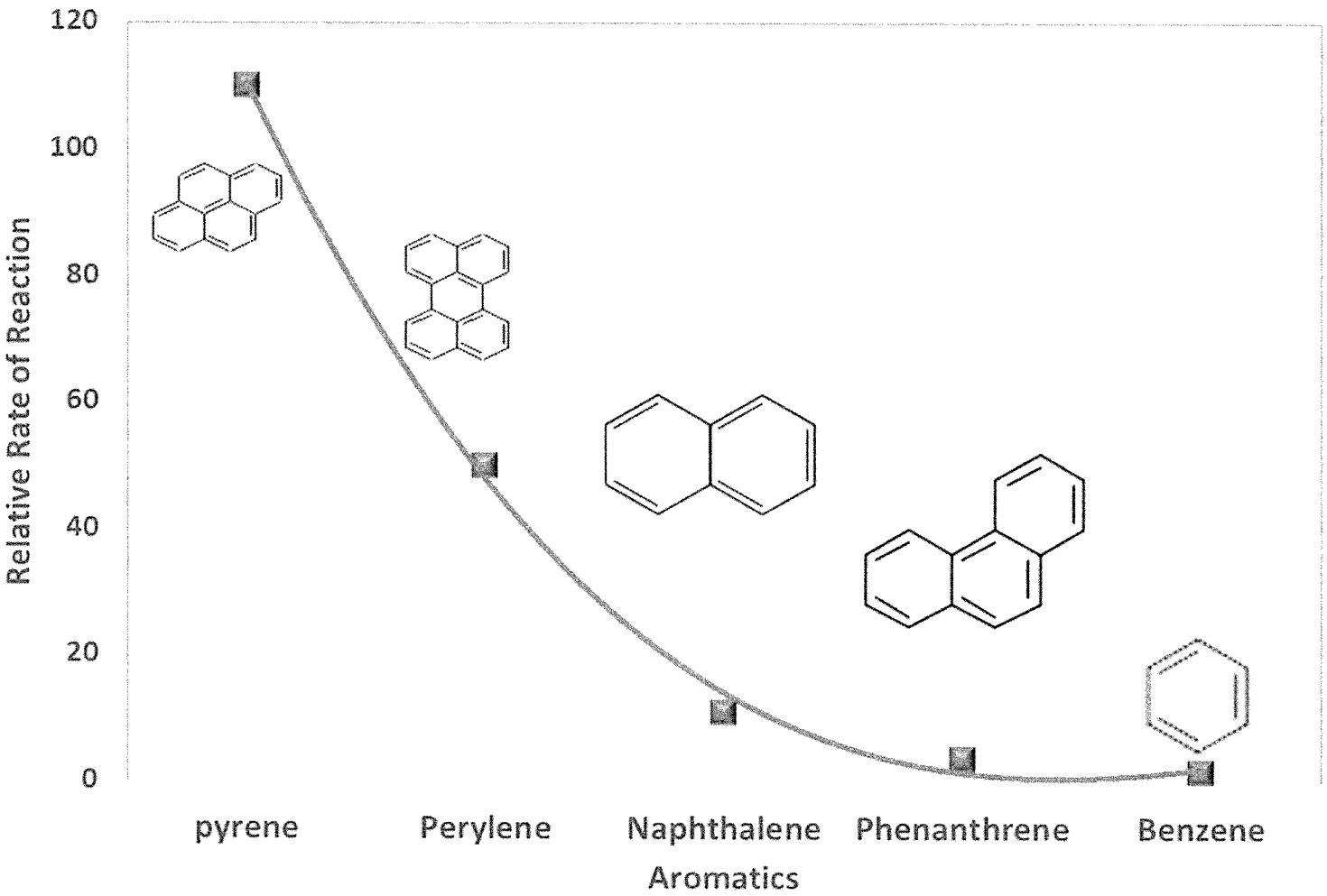
FIG. 7 is a plot of the relative rate of sulfonation reactions for different aromatic compounds.

FIG. 7 illustrates the relative rate of sulfonation reactions for different aromatic compounds. In general, rate of reaction is higher with increasing aromatic rings, due to the increased resonance energy with increasing aromatic ring numbers.

Figure 8:
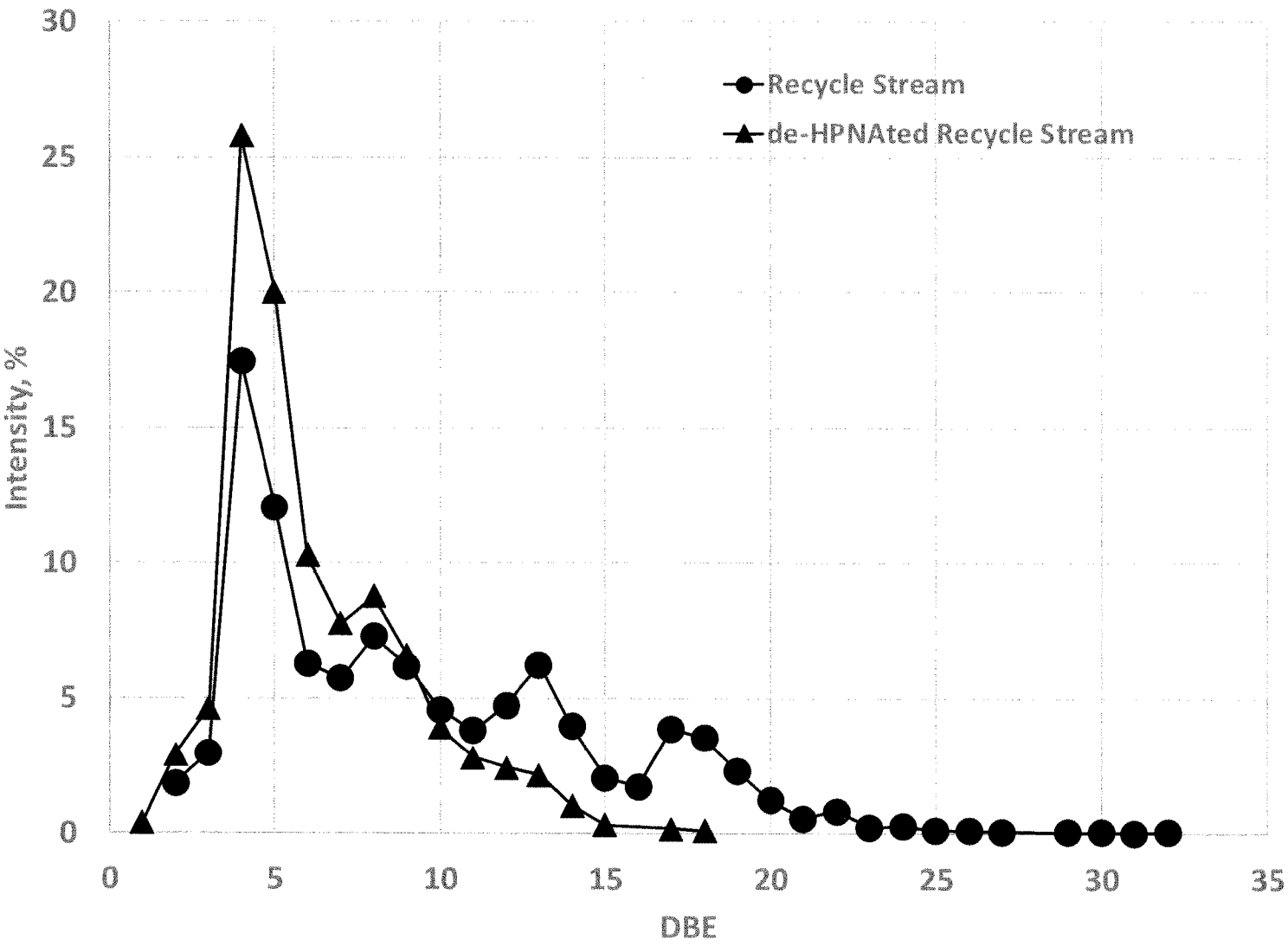
FIG. 8 is a plot of HPNA content in an example herein for hydrocracker bottoms and product obtained after sulfonation, showing double bond equivalence of the hydrocarbons as a function of the intensity.

In an example, a 50 g sample of hydrocracker bottoms recycle was added to a round bottom flask, and 10 g of 99 W % sulfuric acid was added. The mixture was refluxed at 80° C. for one hour. The mixture was then cooled to room temperature, 20° C. The reflux and cooling were carried out with a coolant flowing in a condenser at 10° C. Two-phases in separate layers were observed: A yellow oil phase was the top layer and a black aqueous phase was the bottom layer. The two phases were separated and a sample of each was taken for analysis. The oil phase was analyzed using FT-MS and the HPNA were monitored. FIG. 8 shows the data obtained for the feedstock and the product obtained after the sulfonation. The double bond equivalence of the hydrocarbons is shown as a function of the intensity, showing the relative concentration. The smallest HPNA molecule is seven (7) ring coronene, which has DBE of 19 (12 double bonds and 7 rings). The molecules with DBE of 19 and higher are HPNA and therefore determined to observe the HPNA removal. As is apparent, HPNA compounds are removed from the recycle stream after sulfonation.

While not shown, the skilled artisan will understand that additional equipment, including exchangers, furnaces, pumps, columns, and compressors to feed the reactors, maintain proper operating conditions, and to separate reaction products, are all part of the systems described.

The method and system of the present invention have been described above and in the attached drawings; however, modifications will be apparent to those of ordinary skill in the art and the scope of protection for the invention is to be defined by the claims that follow.

The invention claimed is:

1. A two stage hydrocracking process for hydrocracking of a vacuum gas oil, a demetallized oil, a deasphalted oil, a coker gas oil, a cycle oil or a visbroken oil hydrocarbon stream, the process comprising:

subjecting the vacuum gas oil, demetallized oil, deasphalted oil, coker gas oil, cycle oil or visbroken oil hydrocarbon stream to a first hydrocracking stage to produce a first hydrocracked effluent;

fractionating the first hydrocracked effluent to recover one or more hydrocracked product fractions and a bottoms fraction corresponding to the hydrocracked bottoms fraction, wherein the hydrocracker bottoms fraction contains heavy poly nuclear aromatic (HPNA) compounds that are formed during hydrocracking reactions;

separating HPNA compounds from the hydrocracked bottoms fraction by contacting the hydrocracked bottoms fraction with an effective quantity of a sulfonation agent to promote reaction with HPNA compounds to produce corresponding sulfonated HPNA compounds and to form a sulfonated hydrocracked bottoms fraction, separating the sulfonated hydrocracked bottoms fraction into an HPNA-reduced hydrocracked bottoms portion and a sulfonated HPNA portion, and discharging the sulfonated HPNA portion;

passing all or a portion of the HPNA-reduced hydrocracked bottoms portion to a second hydrocracking stage to produce a second hydrocracked effluent; and subjecting the second hydrocracked effluent to fractionating with the first hydrocracked effluent.

2. The process as in claim 1, further comprising contacting an additional feed with the sulfonation agent.

3. The process as in claim 2, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

4. The process as in claim 1, wherein the sulfonation agent is liquid phase, and wherein contacting the hydrocracked bottoms fraction with the liquid phase sulfonation agent occurs under operating conditions including a reaction temperature in the range of from about 0-150° C., a reaction pressure in the range of from about 1-30 bars, a sulfonation agent to aromatic carbon containing compounds (molar ratio) of from about 1:1-15:1, and a feed rate liquid hourly space velocity based on the volume of the reactor in the range of from about 0.5-20 $h^{-1}$.

5. The process as in claim 4, wherein the sulfonation agent is sulfuric acid.

6. The process as in claim 4, wherein contacting the hydrocracked bottoms fraction with the sulfonation agent comprises introducing the sulfonation agent and the hydrocracked bottoms fraction into a sulfonation reaction zone.

7. The process as in claim 4, wherein contacting the hydrocracked bottoms fraction with the sulfonation agent comprises introducing the sulfonation agent and the hydrocracked bottoms fraction into a contacting and/or mixing zone to promote intimate mixing of oil and sulfonation agent and to produce a mixture, and passing the mixture to a sulfonation reaction zone to promote reaction with HPNA compounds to produce corresponding sulfonated HPNA compounds and to form the sulfonated hydrocracked bottoms fraction.

8. The process as in claim 1, wherein the sulfonation agent is gas phase and is selected from the group consisting of $SO_2$, $SO_3$ and mixtures of $SO_2$ and $SO_3$ and wherein contacting the hydrocracked bottoms fraction with the gas phase sulfonation agent occurs under operating conditions including a reaction temperature in the range of from about 20-600° C., a reaction pressure in the range of from about 0.01 (vacuum)-100 bars, a sulfonation agent to aromatic carbon containing compounds (molar ratio) of from about 1:1-15:1, and a feed rate liquid hourly space velocity based on the volume of the reactor in the range of from about 0.5-20 $h^{-}$.

9. The process as in claim 8, wherein contacting the hydrocracked bottoms fraction with the sulfonation agent comprises introducing the sulfonation agent and the hydrocracked bottoms fraction into a sulfonation reaction zone.

10. The process as in claim 8, wherein contacting the hydrocracked bottoms fraction with the sulfonation agent comprises introducing the sulfonation agent and the hydrocracked bottoms fraction into a contacting and/or mixing zone to promote intimate mixing of oil and sulfonation agent and to produce a mixture, and passing the mixture to a sulfonation reaction zone to promote reaction with HPNA compounds to produce corresponding sulfonated HPNA compounds and to form the sulfonated hydrocracked bottoms fraction.

11. The process as in claim 10, wherein the contacting and/or mixing zone comprises a gas distributor vessel in which gaseous sulfonation agent is injected at plural locations through distributors into the vessel for adequate mixing to effectively dissolve gaseous sulfonation agent in the hydrocracked bottoms fraction.

12. The process as in claim 1, wherein the sulfonated hydrocracked bottoms fraction includes water, and wherein the mixture is phase separated into an aqueous phase containing at least a part of the sulfonated HPNA portion and an oil phase containing at least a part of the HPNA-reduced hydrocracked bottoms portion.

13. The process as in claim 12, wherein the sulfonation agent is provided in an aqueous solution, and wherein the water in the sulfonated hydrocracked bottoms fraction is derived from the aqueous solution.

14. The process as in claim 12, wherein the water in the sulfonated hydrocracked bottoms fraction is added prior to or during phase separating.

15. The process as in claim 1, wherein separating the sulfonated hydrocracked bottoms fraction comprises contacting the sulfonated hydrocracked bottoms fraction with an effective quantity of aromatic selective solvent and under conditions effective to form an extract phase containing the sulfonated HPNA portion, and a raffinate phase containing the HPNA-reduced hydrocracked bottoms portion.

16. The process as in claim 8, further comprising discharging excess gas phase sulfonation agent either:

before separation of the sulfonated bottoms fraction into an HPNA-reduced bottoms portion and a sulfonated HPNA portion; or during separation of the sulfonated bottoms fraction into an HPNA-reduced bottoms portion and a sulfonated HPNA portion.

17. A hydrocracking process for hydrocracking of a vacuum gas oil, a demetallized oil, a deasphalted oil, a coker gas oil, a cycle oil or a visbroken oil hydrocarbon stream, the process comprising:

subjecting the vacuum gas oil, demetallized oil, deasphalted oil, coker gas oil, cycle oil or visbroken oil hydrocarbon stream to one or more hydrocracking stages to produce a hydrocracked effluent;

fractionating the hydrocracked effluent to recover one or more hydrocracked product fractions and a hydrocracked bottoms fraction, wherein the hydrocracker bottoms fraction contains heavy poly nuclear aromatic (HPNA) compounds that are formed during hydrocracking reactions;

separating HPNA compounds from the hydrocracked bottoms fraction by contacting the hydrocracked bottoms fraction with an effective quantity of a sulfonation agent to promote reaction with HPNA compounds to produce corresponding sulfonated HPNA compounds and to form a sulfonated hydrocracked bottoms fraction, separating the sulfonated hydrocracked bottoms fraction into an HPNA-reduced hydrocracked bottoms portion and a sulfonated HPNA portion, and discharging the sulfonated HPNA portion; and recycling all or a portion of the HPNA-reduced hydrocracked bottoms portion to at least one of the one or more hydrocracking stages.

18. The process as in claim 17, further comprising contacting an additional feed with the sulfonation agent, wherein the additional feed is selected from the group consisting of one or more of straight run vacuum gas oil, treated vacuum gas oil, demetallized oil from solvent demetallizing operations, deasphalted oil from solvent deasphalting operations, coker gas oils from coker operations, cycle oils from fluid catalytic cracking operations including heavy cycle oil, and visbroken oils from visbreaking operations, and wherein the additional feed has a boiling point range within about 350-800° C.

19. The process as in claim 17, wherein the sulfonation agent is liquid phase and wherein contacting the hydrocracked bottoms fraction with the liquid phase sulfonation agent occurs under operating conditions including a reaction temperature in the range of from about 0-150° C., a reaction pressure in the range of from about 1-30 bars, a sulfonation agent to aromatic carbon containing compounds (molar ratio) of from about 1:1-15:1, and a feed rate liquid hourly space velocity based on the volume of the reactor in the range of from about 0.5-20 $h^{-}$.

20. The process as in claim 19, wherein contacting the hydrocracked bottoms fraction with the sulfonation agent comprises introducing the sulfonation agent and the hydrocracked bottoms fraction into a contacting and/or mixing zone to promote intimate mixing of oil and sulfonation agent and to produce a mixture, and passing the mixture to a sulfonation reaction zone to promote reaction with HPNA compounds to produce corresponding sulfonated HPNA compounds and to form the sulfonated hydrocracked bottoms fraction.

21. The process as in claim 17, wherein the sulfonation agent is gas phase and is selected from the group consisting of $SO_2$, $SO_3$ and mixtures of $SO_2$ and $SO_3$, and wherein contacting the hydrocracked bottoms fraction with the gas phase sulfonation agent occurs under operating conditions including a reaction temperature in the range of from about 20-600° C., a reaction pressure in the range of from about 0.01 (vacuum)-100 bars, a sulfonation agent to aromatic carbon containing compounds (molar ratio) of from about 1:1-15:1, and a feed rate liquid hourly space velocity based on the volume of the reactor in the range of from about 0.5-20 $h^{-}$.

22. The process as in claim 21, wherein contacting the hydrocracked bottoms fraction with the sulfonation agent comprises introducing the sulfonation agent and the hydrocracked bottoms fraction into a contacting and/or mixing zone to promote intimate mixing of oil and sulfonation agent and to produce a mixture, and passing the mixture to a sulfonation reaction zone to promote reaction with HPNA compounds to produce corresponding sulfonated HPNA compounds and to form the sulfonated hydrocracked bottoms fraction.

23. The process as in claim 22, wherein the contacting and/or mixing zone comprises a gas distributor vessel in which gaseous sulfonation agent is injected at plural locations through distributors into the vessel for adequate mixing to effectively dissolve gaseous sulfonation agent in the hydrocracked bottoms fraction.

24. The process as in claim 17, wherein the sulfonated hydrocracked bottoms fraction includes water, and wherein the mixture is phase separated into an aqueous phase containing at least a part of the sulfonated HPNA portion and an oil phase containing at least a part of the HPNA-reduced hydrocracked bottoms portion.

25. The process as in claim 17, wherein separating the sulfonated hydrocracked bottoms fraction comprises contacting the sulfonated hydrocracked bottoms fraction with an effective quantity of aromatic selective solvent and under conditions effective to form an extract phase containing the sulfonated HPNA portion, and a raffinate phase containing the HPNA-reduced hydrocracked bottoms portion.

* * * * *